US010369426B2

(12) United States Patent
Onuki et al.

(10) Patent No.: US 10,369,426 B2
(45) **Date of Patent: *Aug. 6, 2019**

(54) GOLF CLUB

(71) Applicant: SUMITOMO RUBBER INDUSTRIES, LTD., Kobe-shi, Hyogo (JP)

(72) Inventors: Masahide Onuki, Kobe (JP); Hiroshi Hasegawa, Kobe (JP); Naruhiro Mizutani, Kobe (JP); Yuki Motokawa, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/855,445

(22) Filed: Dec. 27, 2017

(65) Prior Publication Data

US 2018/0178086 A1 Jun. 28, 2018

(30) Foreign Application Priority Data

Dec. 28, 2016 (JP) ..... 2016-255023

(51) Int. Cl.
*A63B 53/02* (2015.01)

(52) U.S. Cl.
CPC ..... *A63B 53/02* (2013.01); *A63B 2053/023* (2013.01)

(58) Field of Classification Search
CPC ..... A63B 2053/023; A63B 53/02
See application file for complete search history.

(56) References Cited

U.S. PATENT DOCUMENTS

| | | | | |
|---|---|---|---|---|
| 1,895,417 | A * | 1/1933 | Lard | A63B 53/12 473/310 |
| 3,810,621 | A * | 5/1974 | Mills | A63B 53/02 473/309 |
| 5,711,719 | A * | 1/1998 | Fireman | A63B 60/00 473/251 |
| 6,270,425 | B1 * | 8/2001 | Dyer | A63B 53/02 473/307 |
| 6,575,843 | B2 * | 6/2003 | McCabe | A63B 53/02 473/245 |

(Continued)

FOREIGN PATENT DOCUMENTS

JP 2006-42950 A 2/2006

*Primary Examiner* — Stephen L Blau
(74) *Attorney, Agent, or Firm* — Birch, Stewart, Kolasch & Birch LLP

(57) ABSTRACT

A golf club includes a head 200, a shaft 300, and a tip engagement part RT having a reverse-tapered shape and being disposed at a tip end portion of the shaft 300. The tip engagement part RT includes a sleeve 400 having a reverse-tapered shape and being fixed to the tip end portion of the shaft 300, and a spacer 500 having a reverse-tapered shape and being externally fitted to the sleeve 400. The spacer 500 has a divided structure. The hosel part 202 includes a hosel hole 204. The hosel hole 204 includes a reverse-tapered hole 206 corresponding to the shape of the outer surface of the tip engagement part RT. The hosel hole 204 allows the sleeve 400 to pass through the hosel hole 204. The tip engagement part RT is fitted to the reverse-tapered hole 206, and the sleeve 400 is fitted inside the spacer 500.

8 Claims, 30 Drawing Sheets

(56) References Cited

U.S. PATENT DOCUMENTS

| | | | | |
|---|---|---|---|---|
| 6,769,994 | B2 * | 8/2004 | Boone | A63B 53/02 473/245 |
| 7,980,959 | B2 | 7/2011 | Morris et al. | |
| 2005/0215345 | A1 * | 9/2005 | Kawakami | A63B 53/02 473/305 |
| 2006/0247071 | A1 * | 11/2006 | Womersley | A63B 53/02 473/340 |
| 2010/0197423 | A1 | 8/2010 | Thomas et al. | |
| 2013/0017901 | A1 | 1/2013 | Sargent et al. | |
| 2013/0210540 | A1 * | 8/2013 | Baumann | A63B 53/007 473/319 |

* cited by examiner

GOLF CLUB

The present application claims priority on Patent Application No. 2016-255023 filed in JAPAN on Dec. 28, 2016, the entire contents of which are hereby incorporated by reference.

BACKGROUND OF THE INVENTION

Field of the Invention

The present invention relates to a golf club.

Description of the Related Art

A golf club including a head and a shaft detachably attached to the head has been proposed.

Each of US2013/0017901 and U.S. Pat. No. 7,980,959 discloses a golf club including a head and a shaft detachably attached to the head. In these golf clubs, a sleeve is attached to a tip end portion of the shaft, and a shaft hole provided in the sleeve is inclined. In these golf clubs, an inclination direction of a shaft axis is changed depending on a fixed position of the sleeve in a circumferential direction. This change enables a loft angle, a lie angle, and a face angle to be adjusted.

Japanese patent No. 5645936 (US2010/0197423) discloses a golf club having a shaft adapter and a head adapter. The degree of freedom of an inclination direction of a shaft axis can be improved by the shaft adapter and the head adapter.

Japanese Patent Application Publication No. 2006-42950 discloses a golf club including: a retaining part bonded to a tip end portion of a shaft; a pair of angle adjustment parts which externally surround the retaining part, and a fixing nut which is screw-connected to male screw parts formed on upper end portions of the angle adjustment parts.

SUMMARY OF THE INVENTION

The present disclosure provides a golf club including a head and a shaft detachably attached to the head, and capable of avoiding the use of a screw for fixing a sleeve from a lower side.

In one aspect, a golf club includes a head having a hosel part, a shaft, and a tip engagement part which has a reverse-tapered shape and is disposed at a tip end portion of the shaft. The tip engagement part includes a sleeve which has a reverse-tapered shape and is fixed to the tip end portion of the shaft, and at least one spacer which has a reverse-tapered shape and is externally fitted to the sleeve. The at least one spacer has a divided structure. The hosel part has a hosel hole. The hosel hole has a reverse-tapered hole having a shape corresponding to a shape of an outer surface of the tip engagement part. The hosel hole allows the sleeve to pass through the hosel hole. The tip engagement part is fitted to the reverse-tapered hole. The sleeve is fitted inside the at least one spacer.

In another aspect, the at least one spacer may have a first divided body, a second divided body, and a connecting part which can maintain a connected state in which the first divided body is connected to the second divided body.

In another aspect, a center line of an inner surface of the sleeve may be inclined with respect to a center line of an outer surface of the sleeve.

In another aspect, the outer surface of the sleeve may be a pyramid surface, and an outer surface of the at least one spacer may be a pyramid surface.

In another aspect, the at least one spacer may comprise two spacers or three spacers, and the two or three spacers are layered on each other.

In another aspect, the tip engagement part may have a taper ratio of equal to or greater than 0.2/30 and equal to or less than 10/30. The reverse-tapered hole may have a taper ratio of equal to or greater than 0.2/30 and equal to or less than 10/30.

In another aspect, a golf club includes a head having a hosel part, a shaft, and a tip engagement part disposed at a tip end portion of the shaft. The tip engagement part may have at least one reverse-tapered engagement face and at least one non-engagement face provided at a circumferential direction position different from that of the reverse-tapered engagement face. The hosel part may have a hosel hole. The hosel hole may have at least one reverse-tapered hole face corresponding to the reverse-tapered engagement face, and at least one interference-avoiding face provided at a circumferential direction position different from that of the reverse-tapered hole face. In a first phase state in which the reverse-tapered engagement face is opposed to the interference-avoiding face, the hosel hole may allow the tip engagement part to pass through the hosel hole. In a second phase state in which the reverse-tapered engagement face is opposed to the reverse-tapered hole face, the reverse-tapered engagement face may be fitted to the reverse-tapered hole face.

In another aspect, the at least one reverse-tapered engagement face may comprise a plurality of reverse-tapered engagement faces. The at least one non-engagement face may comprise a plurality of non-engagement faces. In the tip engagement part, the reverse-tapered engagement faces and the non-engagement faces may be alternately arranged in the circumferential direction. The reverse-tapered engagement faces may constitute a pyramid surface. The at least one reverse-tapered hole face may comprise a plurality of reverse-tapered hole faces. The at least one interference-avoiding face may comprise a plurality of interference-avoiding faces. In the hosel hole, the reverse-tapered hole faces and the interference-avoiding faces may be alternately arranged in the circumferential direction. The reverse-tapered hole faces may constitute a pyramid surface.

In another aspect, the head may further include a falling-off prevention mechanism which regulates moving of the tip engagement part in an engagement releasing direction. The falling-off prevention mechanism may be provided at a sole side of the hosel hole.

In another aspect, the tip engagement part may have a taper ratio of equal to or greater than 0.2/30 and equal to or less than 10/30. The reverse-tapered hole faces may have a taper ratio of equal to or greater than 0.2/30 but equal to or less than 10/30.

BRIEF DESCRIPTION OF THE DRAWINGS

FIG. 5 is the sectional view at a hosel part;

FIG. 12 to FIG. 15 show 16 kinds of constitutions which can be set when the number of spacers is one;

FIG. 13 is also plan views of the lower end surface of the tip engagement part, and shows variations of the position of the center line of the shaft;

FIG. 14 is also plan views of the lower end surface of the tip engagement part, and shows variations of the position of the center line of the shaft;

FIG. 15 is also plan views of the lower end surface of the tip engagement part, and shows variations of the position of the center line of the shaft;

FIG. 16 and FIG. 17 show 8 kinds out of 64 kinds of constitutions which can be set when the number of spacers is two;

FIG. 17 is plan views of the lower end surface of the tip engagement part, and shows variations of the position of the center line of the shaft;

FIG. 30 shows a most difficult situation for inserting the sleeve into the hosel hole.

DESCRIPTION OF THE PREFERRED EMBODIMENTS

In a conventional technique, a sleeve is fixed by using a screw. The screw may be connected to the sleeve from a lower side (sole side), or may be connected to the sleeve from an upper side (grip side).

A large centrifugal force acts on a head during swinging. In addition, a strong impact shock force caused by hitting acts on the head. A screw having sufficient strength is required so that the screw can endure the centrifugal force and the impact shock force. A screw having sufficient strength has a large mass. The mass of the screw hinders the weight saving of the head. The mass of the screw reduces the degree of freedom of the weight distribution of the head. In Japanese Patent Application Publication No. 2006-42950, although a screw fixing a sleeve from a lower side is unnecessary, attachment/detachment of the shaft is not easy.

Hereinafter, the present disclosure will be described in detail according to the preferred embodiments with appropriate references to the accompanying drawings.

Unless otherwise described, "a circumferential direction" in the present application means a circumferential direction of a shaft. Unless otherwise described, "an axial direction" in the present application means an axial direction of the shaft. Unless otherwise described, "an axial perpendicular direction" in the present application means a direction orthogonally crossing the axial direction of the shaft. Unless otherwise described, a section in the present application means a section along a plane perpendicular to a center line of the shaft. Unless otherwise described, a grip side in the axial direction of the shaft is defined as an upper side, and a sole side in the axial direction of the shaft is defined as a lower side.

Figure 1:
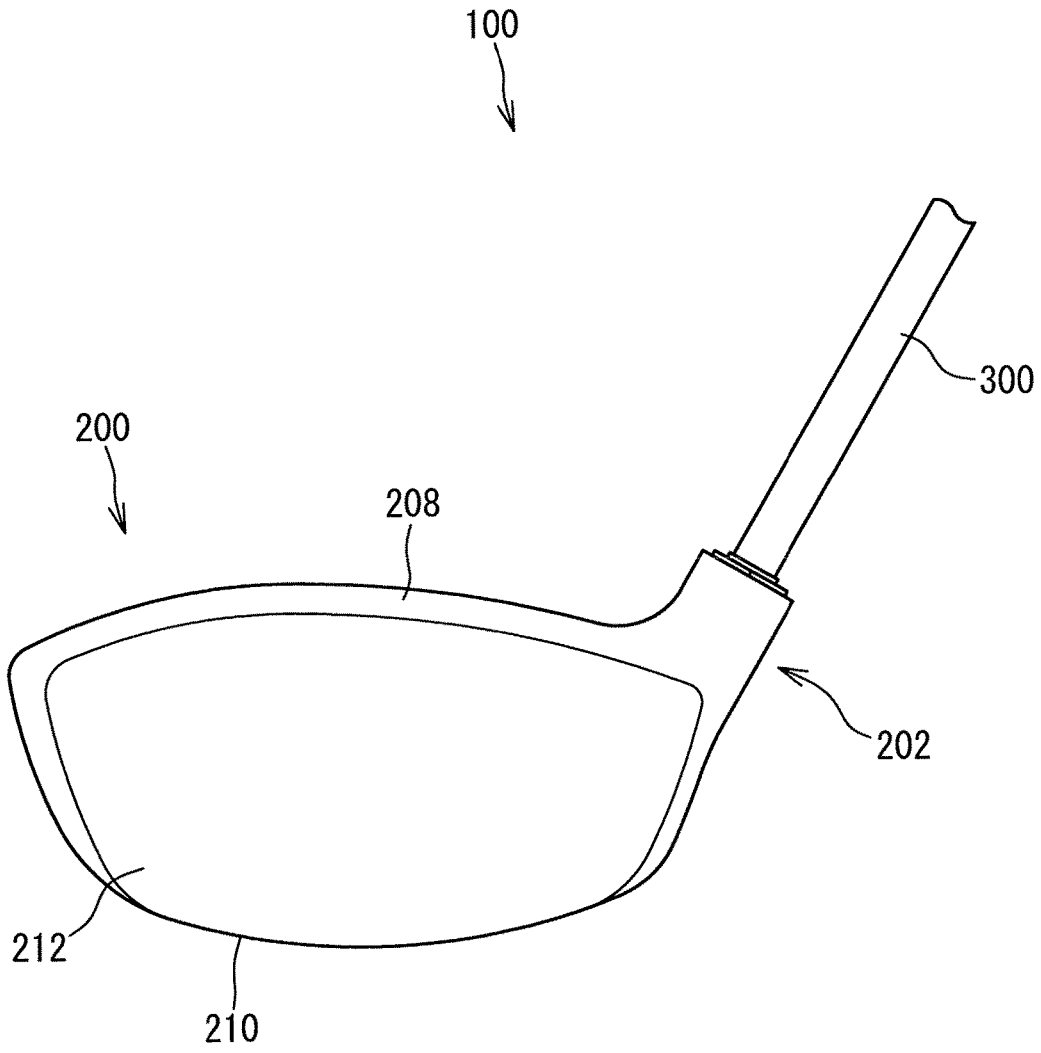
FIG. 1 is a front view of a golf club according to a first embodiment.
Figure 2:
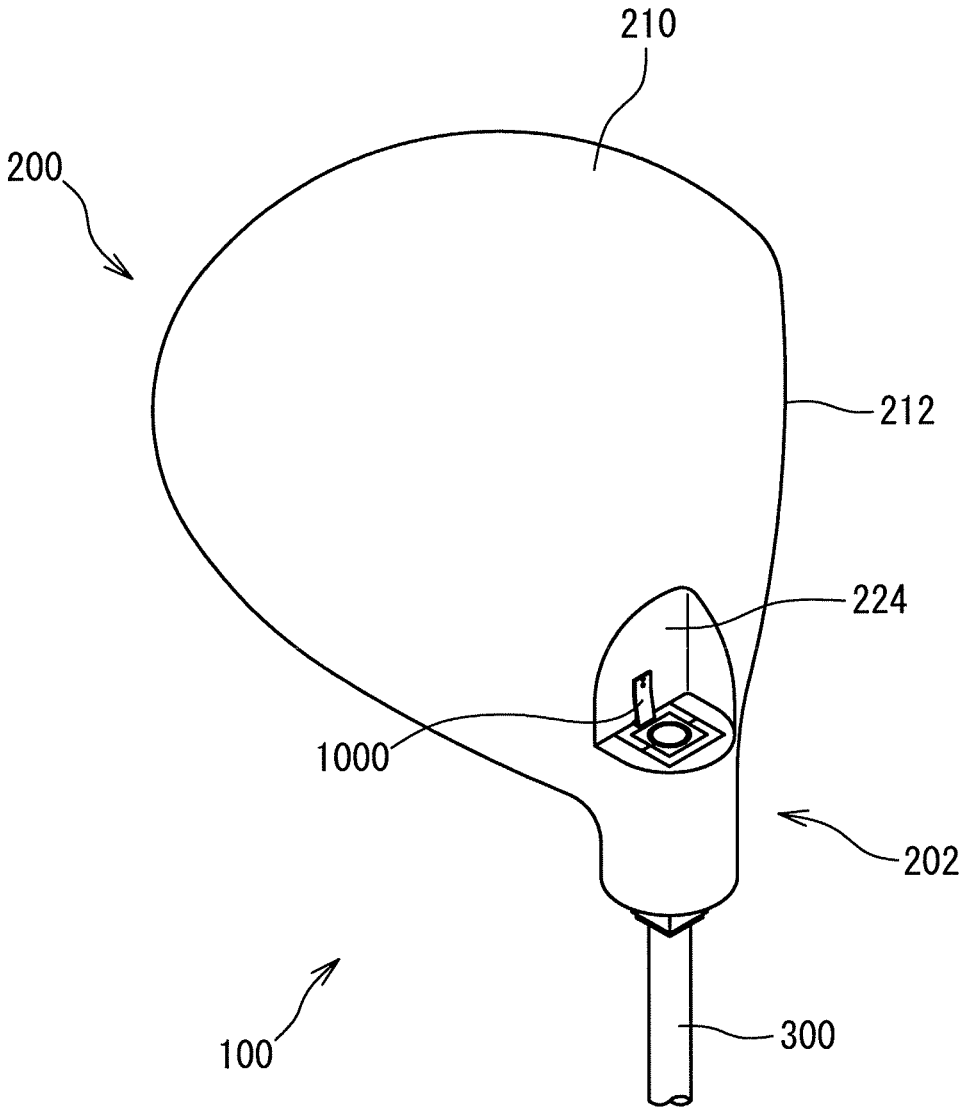
FIG. 2 is a perspective view of the golf club in FIG. 1 as viewed from a sole side.
Figure 3:
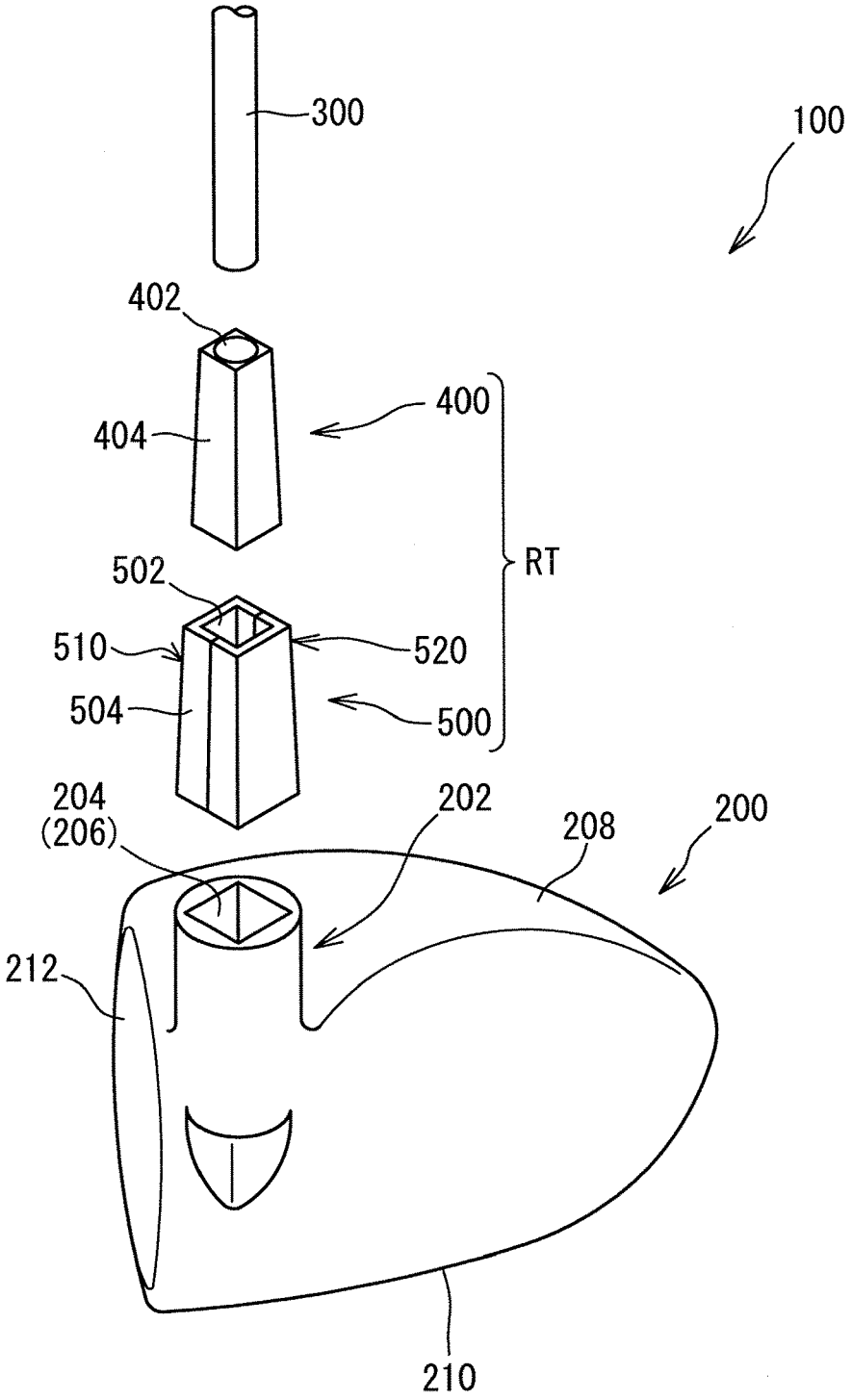
FIG. 3 is an exploded perspective view of the golf club in FIG. 1.

FIG. 1 shows a golf club 100 which is a first embodiment. FIG. 1 shows only the vicinity of a head of the golf club 100. FIG. 2 is a perspective view of the golf club 100 as viewed from a sole side. FIG. 3 is an exploded perspective view of the golf club 100.

The golf club 100 has a head 200, a shaft 300, a sleeve 400, a spacer 500, and a grip (not shown in the drawings). The sleeve 400 and the spacer 500 constitute a tip engagement part RT. The tip engagement part RT is disposed at a tip end portion of the shaft 300. An outer surface of the tip engagement part RT is formed by the spacer 500.

The type of the head 200 is not limited. The head 200 of the present embodiment is a wood type head. The head 200 may be a hybrid type head, an iron type head, a putter head or the like. The wood type head may be a driver head, or maybe ahead of a fairway wood.

The shaft 300 is not limited, and for example, a carbon shaft and a steel shaft may be used. Although not shown in the drawings, the shaft 300 has a diameter varying with an axial direction position thereof. The diameter of the shaft 300 is increased toward the grip side. The spacer 500 is fixed to the tip end portion of the shaft 300. The tip end portion of the shaft 300 is a thinnest portion in the shaft 300.

In the present embodiment, the number of the spacers 500 is one. As described later, the spacer 500 may not be present. As described later, the number of the spacers may be two. That is, two spacers may be stacked. In other words, the spacer may be double-layered. As described later, the number of the spacers may be three or more. For example, three spacers may be stacked. In other words, the spacer may be triple-layered.

The head 200 has a hosel part 202. The hosel part 202 has a hosel hole 204. The hosel hole 204 has a reverse-tapered hole 206. The shape of the reverse-tapered hole 206 corresponds to the shape of the outer surface of the tip engagement part RT. The shape of the reverse-tapered hole 206 corresponds to the shape of the outer surface of the spacer 500. In an engagement state, the outer surface of the tip engagement part RT (the outer surface of the spacer 500) is brought into surface-contact with the reverse-tapered hole 206. The outer surface of the tip engagement part RT has a plurality of (four) planes, and all of the planes are brought into surface-contact with the reverse-tapered hole 206.

The hosel part 202 (reverse-tapered hole 206) exists over the whole circumferential direction. The hosel part 202 (reverse-tapered hole 206) is continuous without a gap in the whole circumferential direction. The hosel part 202 is not split in the circumferential direction. The hosel part 202 does not have a slit formed such that a part of the hosel part in the circumferential direction is lacked.

As with a usual head, the head 200 has a crown 208, a sole 210, and a face 212 (see FIGS. 1 to 3).

As shown in FIG. 3, the sleeve 400 has an inner surface 402 and an outer surface 404. The inner surface 402 forms a shaft hole. The sectional shape of the inner surface 402 is a circle. The shape of the inner surface 402 corresponds to the shape of an outer surface of the shaft 300. The inner surface 402 is fixed to the tip end portion of the shaft 300. That is, the sleeve 400 is fixed to the tip end portion of the shaft 300. An adhesive is used for the fixation.

The outer surface 404 is a pyramid surface. The outer surface 404 is a four-sided pyramid surface. The sectional shape of the outer surface 404 is a non-circle. The sectional shape of the outer surface 404 is a polygon (regular polygon). The sectional shape of the outer surface 404 is a tetragon. The sectional shape of the outer surface 404 is a square. The area of a figure formed by a sectional line of the outer surface 404 is increased toward a tip side of the shaft 300. That is, the sleeve 400 has a reverse-tapered shape.

As shown in FIG. 3, the spacer 500 has an inner surface 502 and an outer surface 504. The inner surface 502 forms a sleeve hole. The sectional shape of the inner surface 502 corresponds to the sectional shape of the outer surface 404 of the sleeve 400. The outer surface 404 of the sleeve 400 is fitted to the inner surface 502. In other words, the sleeve 400 is fitted inside the spacer 500. The spacer 500 is not bonded to the sleeve 400. The spacer 500 is merely brought into contact with the sleeve 400.

The shape of the inner surface 502 corresponds to the shape of the outer surface 404 of the sleeve 400. The inner surface 502 is a pyramid surface. The inner surface 502 is a four-sided pyramid surface. The sectional shape of the inner surface 502 is a non-circle. The sectional shape of the inner surface 502 is a polygon (regular polygon). The sectional shape of the inner surface 502 is a tetragon. The sectional shape of the inner surface 502 is a square. The area of a figure formed by a sectional line of the inner surface 502 is increased toward the tip side of the shaft 300.

The shape of the outer surface 504 (outer surface of the tip engagement part RT) corresponds to the shape of the reverse-tapered hole 206. The outer surface 504 is a pyramid surface. The outer surface 504 is a four-sided pyramid surface. The sectional shape of the outer surface 504 is a non-circle. The sectional shape of the outer surface 504 is a polygon (regular polygon). The sectional shape of the outer surface 504 is a tetragon. The sectional shape of the outer surface 504 is a square. The area of a figure formed by a sectional line of the outer surface 504 is increased toward the tip side of the shaft 300. That is, the spacer 500 has a reverse-tapered shape. The sleeve 400 and the spacer 500 constitute the tip engagement part RT.

Figure 4:
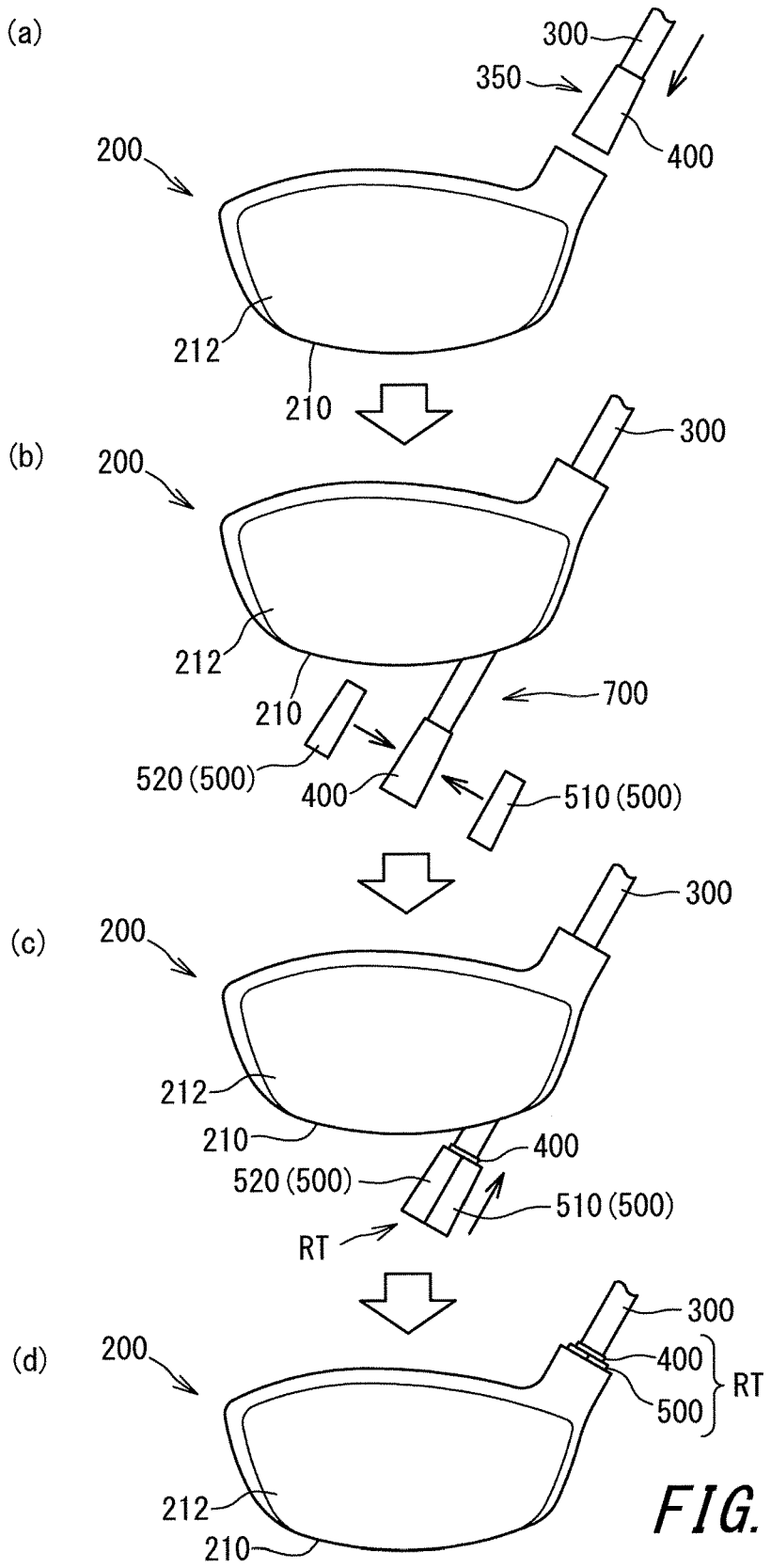
FIG. 4 is an assembling process view of the golf club in FIG. 1.

FIG. 4 shows a procedure of mounting the shaft 300 to the head 200.

In the mounting procedure, an intermediate body 350 is first prepared (step (a) in FIG. 4). The intermediate body 350 has a shaft 300 and a sleeve 400. In the intermediate body 350, the sleeve 400 is fixed (bonded) to the tip end portion of the shaft 300.

Next, the sleeve 400 of the intermediate body 350 is made to pass through the hosel hole 204 (step (b) in FIG. 4). The sleeve 400 is made to completely pass through the hosel hole 204. The sleeve 400 is inserted to the hosel hole 204 from the upper side and is come out from the lower side of the hosel hole 204. An outer diameter of a lower end surface of the sleeve 400 is smaller than an inner diameter of an upper end of the hosel hole 204. The sleeve 400 can be made to pass through the hosel hole 204 at any phase. The sleeve 400 is moved to a lower side of the sole 210 by the passing (step (b) in FIG. 4).

Next, the spacer 500 is attached to the sleeve 400 (step (c) in FIG. 4). The spacer 500 is externally attached to the sleeve 400. The spacer 500 is attached to externally cover the sleeve 400. The tip engagement part RT is completed by attaching the spacer 500 to the sleeve 400. As described later, the spacer 500 has a divided structure. This divided structure makes it possible to attach the spacer 500 externally to the sleeve 400.

Next, the intermediate member 350 is moved upward with respect to the head 200, and thereby the tip engagement part RT (spacer 500) is fitted to the reverse-tapered hole 206 (step (d) in FIG. 4). As a result, the shaft 300 is attached to the head 200. The mounting of the shaft 300 to the head 200 is achieved by the fitting. In other words, an engagement state is achieved by the fitting. The engagement state is a state where the golf club 100 can be used. In the engagement state, all reverse-tapered fittings are achieved. All reverse-tapered fittings mean: a fitting between the outer surface 404 and the inner surface 502; and a fitting between the outer surface 504 and the reverse-tapered hole 206.

Thus, the shaft 300 is easily attached to the head 200. In addition, the shaft 300 can be detached from the head 200 by reversing the steps. The detachment is also easily performed. In the golf club 100, the shaft 300 is detachably attached to the head 200.

Figure 5:
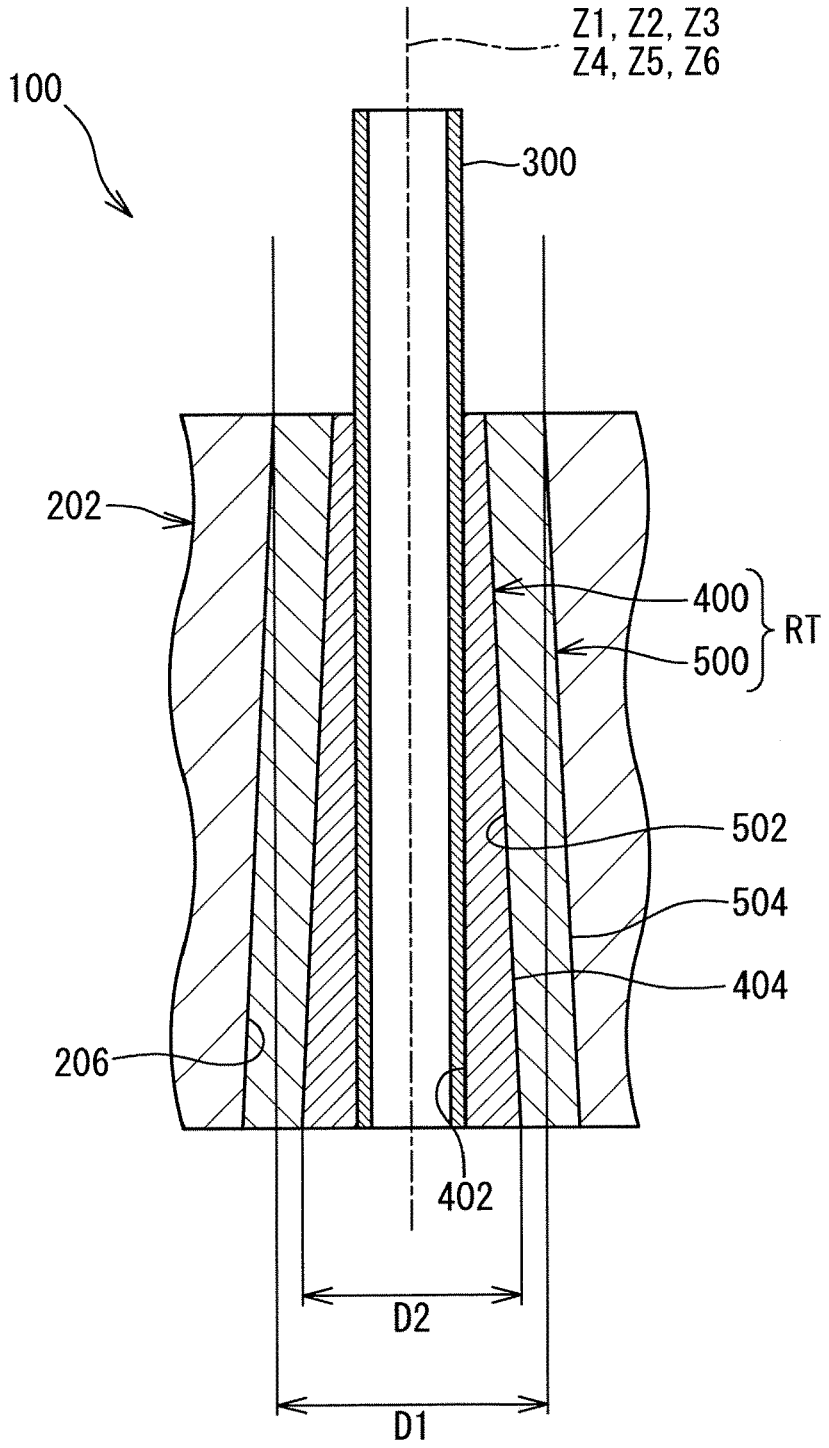
FIG. 5 is a sectional view of the golf club in FIG. 1.
Figure 6:
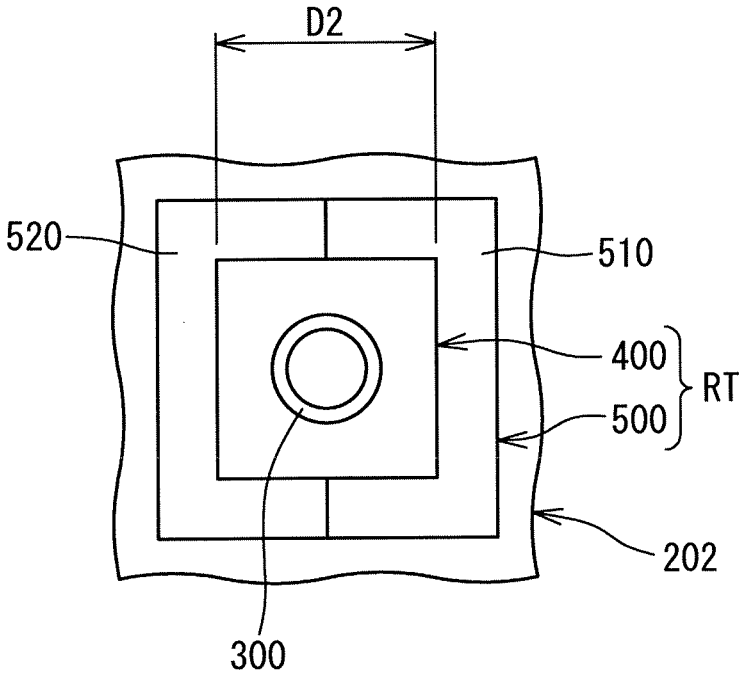
FIG. 6 is a bottom view in the vicinity of a tip engagement part according to a first embodiment.

FIG. 5 is a sectional view of the golf club 100 taken along the axial direction. FIG. 5 is an enlarged sectional view of the vicinity of the tip engagement part RT. FIG. 6 is a plan view of the tip engagement part RT as viewed from the lower side (sole side).

In the present embodiment, a center line Z1 of the inner surface 402 of the sleeve 400 is not inclined with respect to a center line Z2 of the outer surface 404 of the sleeve 400. The center line Z1 conforms to the center line Z2. A center line Z3 of the shaft 300 is not inclined with respect to the center line Z2 of the outer surface 404 of the sleeve 400. The center line Z3 conforms to the center line Z2. A center line Z4 of the inner surface 502 of the spacer 500 is not inclined with respect to a center line Z5 of the outer surface 504 of the spacer 500. The centerline Z4 conforms to the center line Z5. The center line Z4 of the inner surface 502 of the spacer 500 is not inclined with respect to a center line Z6 of the reverse-tapered hole 206 of the head 200. The center line Z4 conforms to the center line Z6. The center line Z3 of the shaft 300 is not inclined with respect to the center line Z6 of the reverse-tapered hole 206 of the head 200. The center line Z3 conforms to the center line Z6.

A double-pointed arrow D1 in FIG. 5 shows the minimum width of the hosel hole 204. In the present embodiment, the sectional shape of the hosel hole 204 is a square, and the minimum width D1 is the length of one side of the square at the upper end of the hosel hole 204.

A double-pointed arrow D2 in FIG. 5 shows the maximum width of the sleeve 400. In the present embodiment, the sectional shape of the outer surface 404 of the sleeve 400 is a square, and the maximum width D2 is the length of one side of the square at the lower end surface of the sleeve 400.

In the present embodiment, the minimum width D1 is larger than the maximum width D2. In other words, the minimum value of the sectional area of the hosel hole 204 is larger than the maximum value of the sectional area of the sleeve 400. The lower end of the sleeve 400 can pass through an opening of the upper end of the hosel hole 204. As a result, the sleeve 400 can pass through the hosel hole 204. The sleeve 400 can be inserted to the hosel hole 204 from the upper side, pass through the hosel hole 204, and come out from the lower side of the hosel hole 204. The thickness of the spacer 500 is set such that the minimum width D1 is larger than the maximum width D2.

Figure 7:
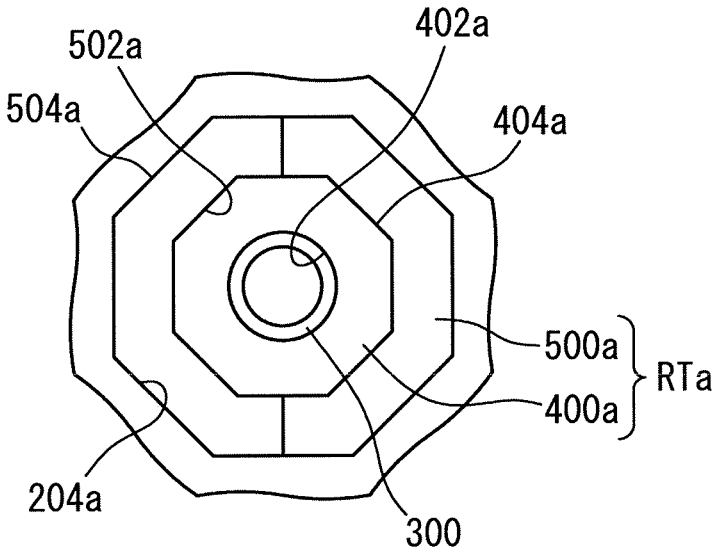
FIG. 7 is a bottom view of the vicinity of a tip engagement part according to a modification example.

FIG. 7 is a plan view of a tip engagement part RTa according to a modification example as viewed from the sole side. The tip engagement part RTa has a sleeve 400*a* and a spacer 500*a*. The sleeve 400*a* and the spacer 500*a* constitute the tip engagement part RTa.

The sleeve 400*a* has an inner surface 402*a* and an outer surface 404*a*. The inner surface 402*a* forms a shaft hole. The sectional shape of the inner surface 402*a* is a circle. The shape of the inner surface 402*a* corresponds to the shape of the outer surface of the shaft 300. The inner surface 402*a* is fixed to the tip end portion of the shaft 300. That is, the sleeve 400*a* is fixed to the tip end portion of the shaft 300. An adhesive is used for the fixation.

The outer surface 404*a* is a pyramid surface. The outer surface 404*a* is an eight-sided pyramid surface. The sectional shape of the outer surface 404*a* is a non-circle. The sectional shape of the outer surface 404*a* is a polygon (regular polygon). The sectional shape of the outer surface 404*a* is an octagon. The sectional shape of the outer surface 404*a* is a regular octagon. The area of a figure formed by a sectional line of the outer surface 404*a* is increased toward the tip side of the shaft 300. That is, the sleeve 400*a* has a reverse-tapered shape.

The spacer 500*a* has an inner surface 502*a* and an outer surface 504*a*. The inner surface 502*a* forms a sleeve hole. The sectional shape of the inner surface 502*a* corresponds to the sectional shape of the outer surface 404*a* of the sleeve 400*a*. The outer surface 404*a* of the sleeve 400*a* is fitted to the inner surface 502*a*. In other words, the sleeve 400*a* is fitted inside the spacer 500*a*. The spacer 500*a* is not bonded to the sleeve 400*a*. The spacer 500*a* is merely brought into contact with the sleeve 400*a*.

The shape of the inner surface 502*a* corresponds to the shape of the outer surface 404*a* of the sleeve 400*a*. The inner surface 502*a* is a pyramid surface. The inner surface 502*a* is an eight-sided pyramid surface. The sectional shape of the inner surface 502*a* is a non-circle. The sectional shape of the inner surface 502*a* is a polygon (regular polygon). The sectional shape of the inner surface 502*a* is an octagon. The sectional shape of the inner surface 502*a* is a regular octagon. The area of a figure formed by a sectional line of the inner surface 502*a* is increased toward the tip side of the shaft 300.

The shape of the outer surface 504*a* (outer surface of the tip engagement part RTa) corresponds to the shape of a reverse-tapered hole 206*a*. The outer surface 504*a* is a pyramid surface. The outer surface 504*a* is an eight-sided pyramid surface. The sectional shape of the outer surface 504*a* is a non-circle. The sectional shape of the outer surface 504*a* is a polygon (regular polygon). The sectional shape of the outer surface 504*a* is an octagon. The sectional shape of the outer surface 504*a* is a regular octagon. The area of a figure formed by a sectional line of the outer surface 504*a* is increased toward the tip side of the shaft 300.

Figure 8:
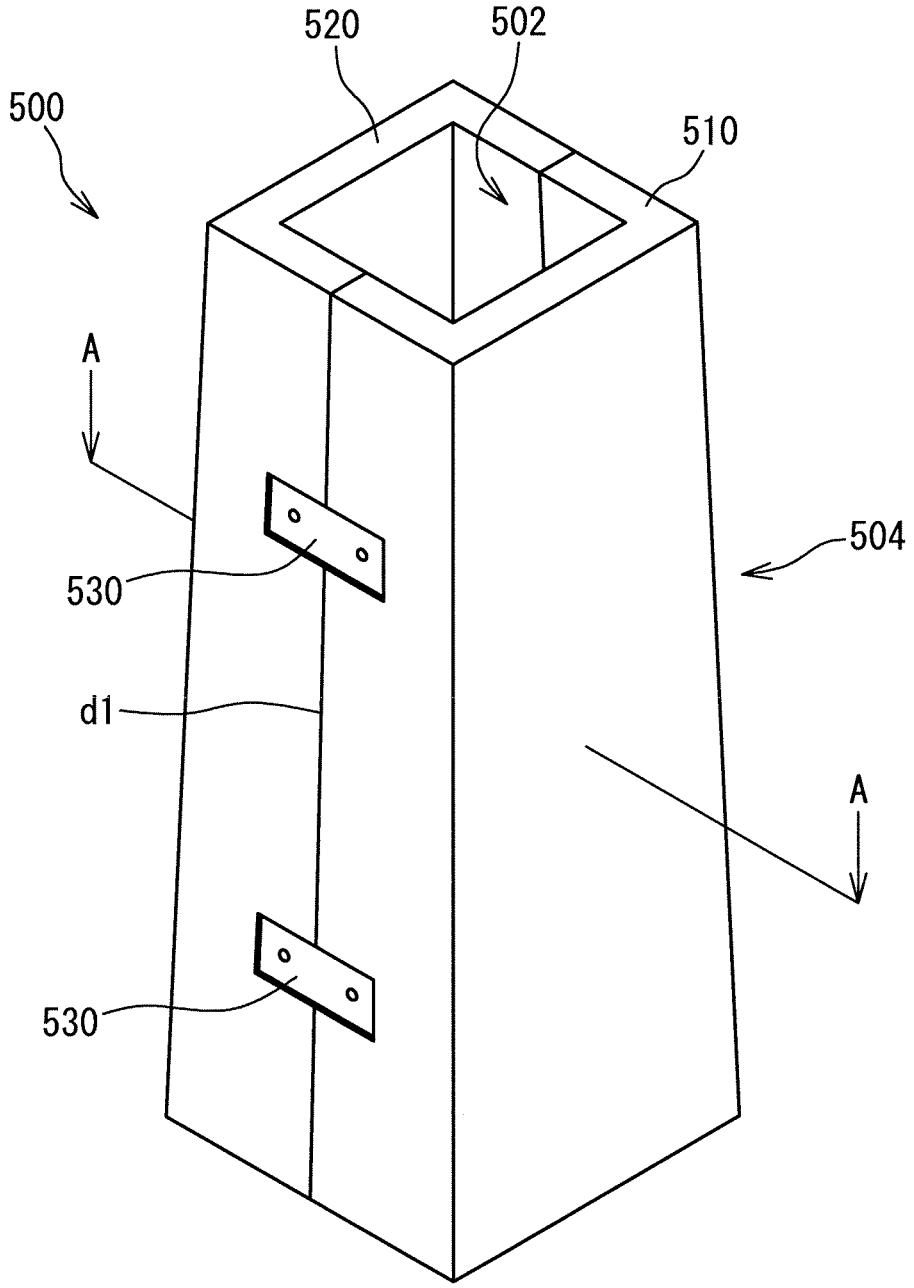
FIG. 8 is a perspective view of a spacer.
Figure 9A:
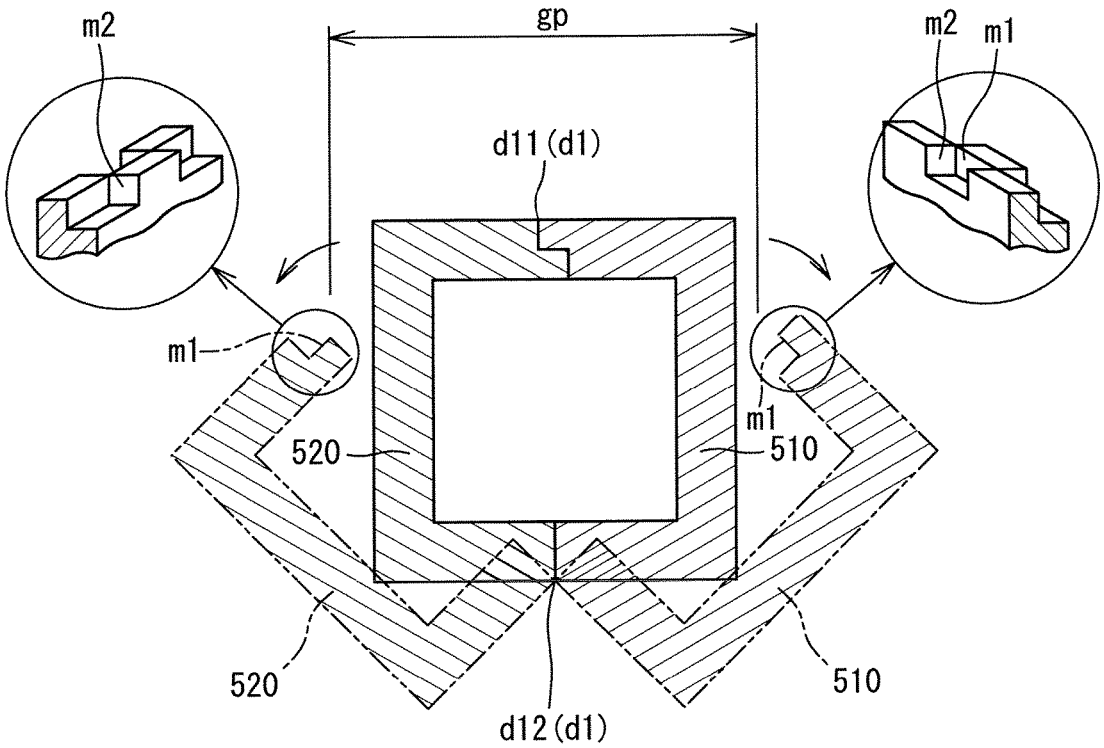
FIG. 9(*a*) is a sectional view of the spacer in FIG. 8, FIG. 9(*b*) is a partial sectional view of a spacer of a modification example, and FIG. 9(*c*) is a partial sectional view of a spacer of a modification example.
Figure 9B:
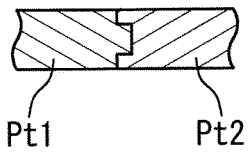
Figure 9C:
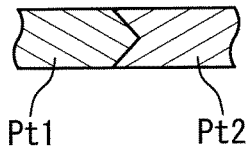

FIG. 8 is a perspective view of the spacer 500. FIG. 9 (a) is a sectional view taken along line A-A in FIG. 8. As described above, the spacer 500 has the inner surface 502 and the outer surface 504.

The spacer 500 has a divided structure. The spacer 500 has a first divided body 510 and a second divided body 520. A divisional line d1 is shown in FIG. 8. The divisional line d1 is a boundary between the first divided body 510 and the second divided body 520.

The spacer 500 has a connecting part 530, although not shown in the drawings except FIG. 8. In the present embodiment, the connecting part 530 is a plate spring. The plate spring is an elastic body. In the present embodiment, two connecting parts 530 are provided. One side of each of the connecting parts 530 is fixed to the first divided body 510, and the other side of each of the connecting parts 530 is fixed to the second divided body 520.

The connecting parts 530 are housed in respective recessed parts provided on the outer surface 504. The connecting parts 530 are not projected outside the outer surface 504. The connecting parts 530 do not hamper contact between the reverse-tapered hole 206 and the outer surface 504.

Although the step (b) in FIG. 4 shows that the first divided body 510 and the second divided body 520 are separated from each other, the spacer 500 is actually configured to open and close. The connecting parts 530 play the role of a hinge. The spacer 500 opens on the connecting parts 530. The spacer 500 opens by applying an external force. This opened state is shown by two-dot chain lines in FIG. 9(*a*). The spacer 500 opens by bending the connecting parts 530 (plate springs). In this opened state, a gap gp is produced between the first divided body 510 and the second divided body 520. The sleeve 400 can be put inside the spacer 500 through the gap gp. The spacer 500 is closed in a state where the sleeve 400 is put inside the spacer. The plate springs 530 bias the spacer 500 so that the spacer 500 is in a closed state. Therefore, the spacer 500 is (automatically) closed if the external force is lost.

The connecting parts 530 can maintain a connected state in which the first divided body 510 is connected to the second divided body 520. The spacer 500 is in the connected state when an external force does not act on the spacer 500. The connected state is a state of the spacer 500 in the golf club 100 usable as a club.

The spacer 500 has a position adjusting structure to prevent a positional displacement between the first divided body 510 and the second divided body 520. As the position adjusting structure, a plate splicing structure maybe applied. The embodiment of FIG. 9(*a*) includes an example of the position adjusting structure. In the position adjusting structure, the first divided body 510 has an abutting surface m1 which prevents the positional displacement in a thickness direction, and an abutting surface m2 which prevents the positional displacement in an axial direction. Similarly, the second divided body 520 has the abutting surface m1 which prevents the positional displacement in the thickness direction, and the abutting surface m2 which prevents the positional displacement in the axial direction. In the spacer 500 in the closed state, the abutting surface m1 of the first divided body 510 abuts on the abutting surface m1 of the second divided body 520, and the abutting surface m2 of the first divided body 510 abuts on the abutting surface m2 of the second divided body 520. Therefore, the positional displacements in the thickness direction and the axial direction are prevented.

The spacer 500 can fulfill the position adjusting function even if the spacer 500 does not have the position adjusting structure because the spacer 500 is fitted to the outer surface of the sleeve, the inner surface of the hosel hole, etc. In comparison between the abutting surfaces m1 and the abutting surfaces m2, the abutting surfaces m2 which prevent the positional displacement in the axial direction is more effective. This is because the spacer 500 is fitted to the outer surface of the sleeve, the inner surface of the hosel hole, etc., and thus the positional displacement in the thickness direction is less likely to occur. In this respect, the position adjusting structure preferably includes the abutting surfaces m2 which prevent the positional displacement in the axial direction, and more preferably includes the abutting surfaces m2 which prevent the positional displacement in the axial direction, and the abutting surfaces m1 which prevent the positional displacement in the thickness direction.

As shown in FIG. 9(*a*), the divisional line d1 of the spacer 500 includes a first divisional line d11 and a second divisional line d12. The first divisional line d11 is a divisional line on which the connecting parts 530 are not present. The second divisional line d12 is a divisional line on which the connecting parts 530 are present. In FIG. 9(*a*), the above-described position adjusting structure provided on the first divisional line d11 is shown. Preferably, the position adjusting structure is provided also on the second divisional line d12.

FIG. 9(*b*) shows another position adjusting structure. In this position adjusting structure, a projection of a first member Pt1 and a recess of a second member Pt2 are butted against each other. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

FIG. 9(*c*) shows another position adjusting structure. In this position adjusting structure, a projection of a first member Pt1 and a recess of a second member Pt2 are butted against each other. The section of the projection of the first member Pt1 is constituted by slopes. The section of the recess of the second member Pt2 is constituted by slopes. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

The position adjusting structures shown in FIG. 9(*b*) and FIG. 9(*c*) can also prevent the positional displacement in the axial direction in addition to the positional displacement in the thickness direction. For example, when such a position adjusting structure as shown in FIG. 9(*b*) or FIG. 9(*c*) is adopted only at a part of the axial direction, an abutting surface capable of preventing the positional displacement in the axial direction can be formed at a termination position of the position adjusting structure. Therefore, the positional displacement in the axial direction can be prevented.

Figure 10:
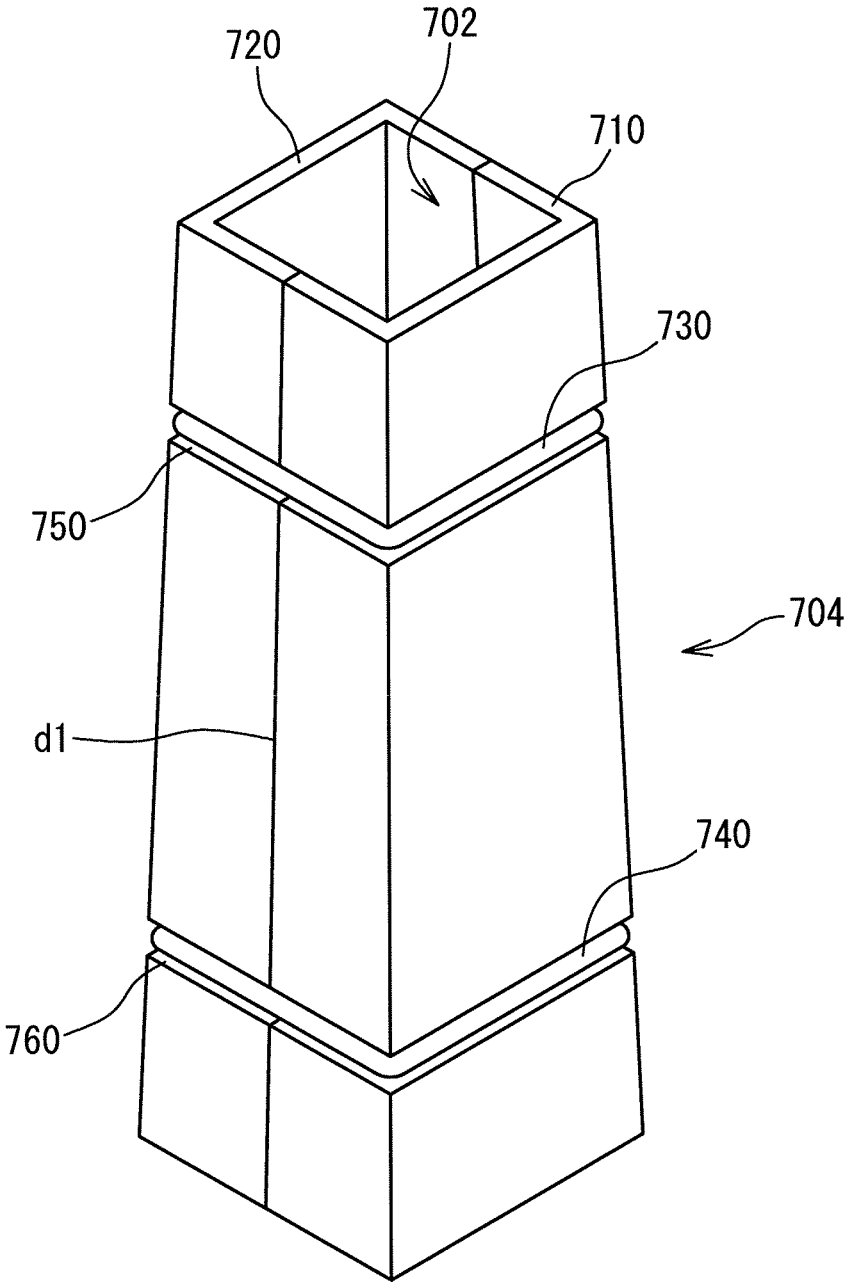
FIG. 10 is a perspective view of a spacer according to a modification example.

FIG. 10 is a perspective view of a spacer 700 according to another modification example. The spacer 700 has an inner surface 702 and an outer surface 704.

The spacer 700 has a divided structure. The spacer 700 has a first divided body 710 and a second divided body 720. A divisional line d1 is shown in FIG. 10. The divisional line d1 is a boundary between the first divided body 710 and the second divided body 720.

The spacer 700 has ring-shaped elastic bodies 730 and 740. The spacer 700 further has circumferential grooves 750 and 760. The elastic bodies 730 and 740 are fitted to the circumferential grooves 750 and 760, respectively. The elastic bodies 730 and 740 are not projected outside the outer surface 704. The elastic bodies 730 and 740 do not hamper contact between the outer surface 704 and a reverse-tapered surface to which the outer surface 704 is fitted. The reverse-tapered surface to which the outer surface 704 is fitted is the reverse-tapered hole of the head or an inner surface of another spacer. The elastic bodies 730 and 740 are an example of a connecting part capable of maintaining a connected state in which the first divided body 710 and the second divided body 720 are connected to each other.

The elastic bodies 730 and 740 can be removed by applying an external force to stretch the elastic bodies 730 and 740. The first divided body 710 and the second divided body 720 can be separated from each other by removing the elastic bodies 730 and 740. On the contrary, the elastic bodies 730 and 740 can be attached after butting the first divided body 710 and the second divided body 720 against each other. The elastically contractile force of the elastic bodies 730 and 740 biases the divided bodies 710 and 720 so that the two divided bodies 710 and 720 are abutted against each other. For example, this spacer 700 also enables to replace a spacer.

Thus, the spacer 500 and the spacer 700 each have the divided structure. The spacer 500 and the spacer 700 each have the first divided body and the second divided body. The spacer 500 and the spacer 700 each have the connecting part capable of maintaining the connected state in which the first divided body is connected to the second divided body. In the spacer 500 and the spacer 700, the mutual transition between the connected state in which the first divided body and the second divided body are connected to each other, and a separated state in which a gap is formed between the first divided body and the second divided body is enabled. In the separated state, the sleeve can be disposed inside the spacer by allowing the sleeve to pass through the gap. In the separated state, the spacer can be detached from or attached to the shaft 300 to which the sleeve 400 is fixed.

Figure 11:
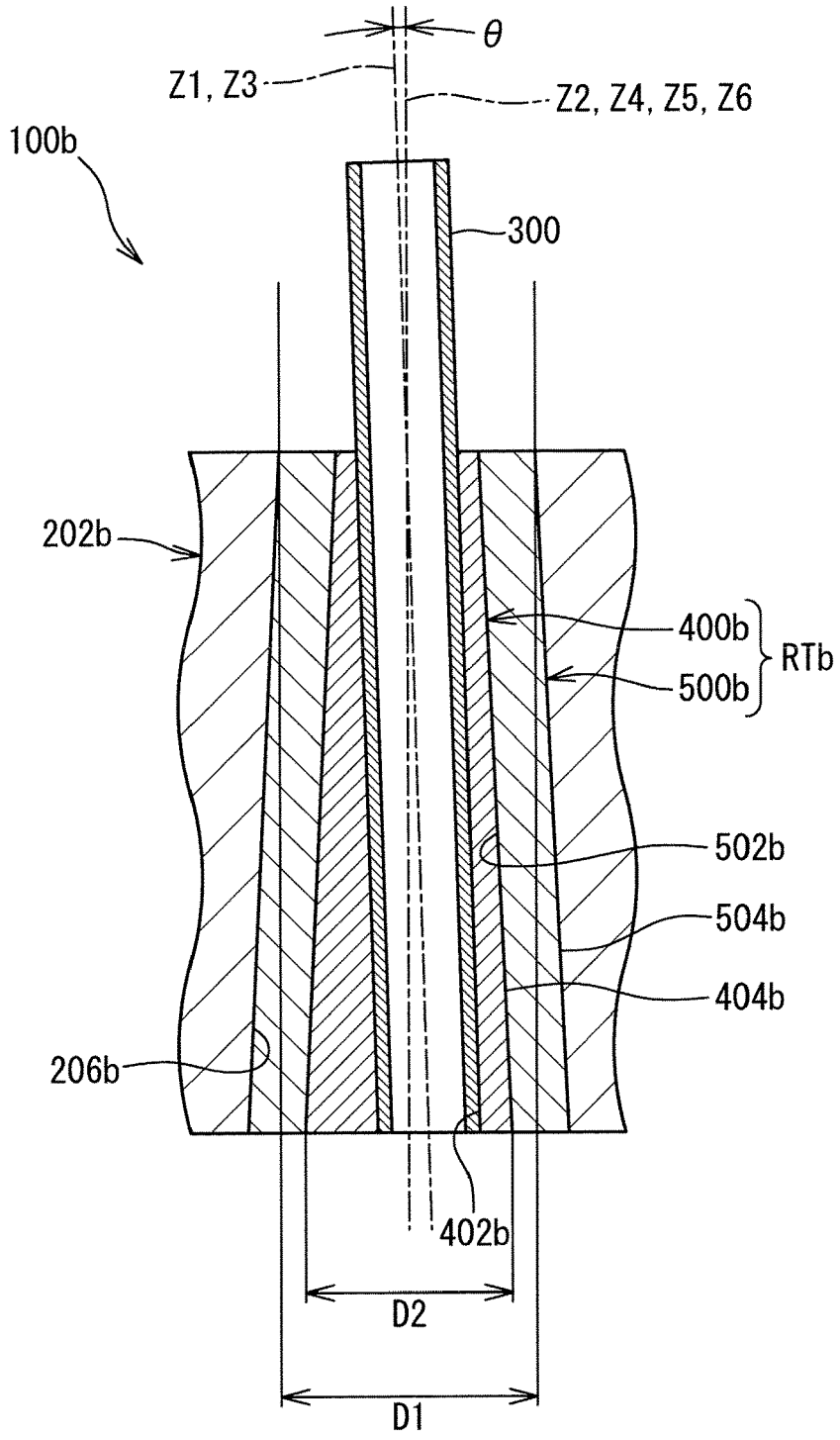
FIG. 11 is a sectional view of a golf club according to a modification example.

FIG. 11 is a sectional view of a golf club 100*b* according to another embodiment. FIG. 11 is an enlarged sectional view of the vicinity of a tip engagement part RTb.

In the present embodiment, a center line Z1 of an inner surface 402*b* of a sleeve 400*b* is inclined with respect to a center line Z2 of an outer surface 404*b* of the sleeve 400*b*. The inclination angle is 8 degree. The center line Z3 of the shaft 300 is inclined with respect to the center line Z2 of the outer surface 404*b* of the sleeve 400*b*. The inclination angle is θ degree. A center line Z4 of an inner surface 502*b* of a spacer 500*b* is not inclined with respect to a center line Z5 of an outer surface 504*b* of the spacer 500*b*. The center line Z4 conforms to the center line Z5. The center line Z4 of the inner surface 502*b* of the spacer 500*b* is not inclined with respect to a center line Z6 of a reverse-tapered hole 206*b* of a head 200*b*. The center line Z4 conforms to the centerline Z6. The center line Z3 of the shaft 300 is inclined with respect to the center line Z6 of the reverse-tapered hole 206*b*. The inclination angle θ degree.

Thus, in the embodiment of FIG. 11, the center line Z1 of the inner surface 402*b* of the sleeve 400*b* is inclined with respect to the center line Z6 of the reverse-tapered hole 206*b*. Therefore, a loft angle and a lie angle can be changed based on a rotation position of the sleeve 400*b*. The embodiment of FIG. 11 has an angle adjusting function.

The center line Z4 of the inner surface 502*b* of the spacer 500*b* may be inclined with respect to the center line Z5 of the outer surface 504*b* of the spacer 500*b*. The inclination of the center line Z1 as mentioned above may be combined with the inclination of the center line Z4. This combination enhances the degree of freedom of angle adjustment.

[Rotation Position of Sleeve]

The sleeve can be rotated about the center line of the sleeve itself. The rotation position of the sleeve is changed by the rotation. In the engagement state, the sleeve can take a plurality of rotation positions. The number of the rotation positions which can be taken is set based on the shape of the outer surface of the sleeve.

[Rotation Position of Spacer]

The spacer can be rotated about the center line of the spacer itself. The rotation position of the spacer is changed by the rotation. In the engagement state, the spacer can take a plurality of rotation positions. The number of the rotation positions which can be taken is set based on the shape of the outer surface of the spacer.

[Adjustment of Position and Direction of Center Line of Shaft]

The center line of the shaft hole (the center line of the shaft) can be displaced with respect to the center line of the outer surface of the sleeve. These center lines maybe inclined with respect to each other, or may be displaced in parallel to each other (parallel and eccentric). Inclination and eccentricity may be combined. In this case, the direction and/or the position of the center line of the shaft can be changed by the rotation position of the sleeve.

The center line of the inner surface of the spacer can be displaced with respect to the center line of the outer surface of the spacer. These center lines maybe inclined with respect to each other, or may be displaced in parallel to each other (parallel and eccentric). Inclination and eccentricity may be combined. In this case, the direction and/or the position of the center line of the shaft can be changed by the rotation position of the spacer.

The rotation position of the spacer can be selected independently of the rotation position of the sleeve. In addition, when a plurality of spacers are used, rotation positions of the respective spacers can be selected independently of each other. The degree of freedom of the adjustment is enhanced by the spacer. The degree of freedom of the adjustment is further enhanced by using a plurality of spacers. In these respects, the number of the spacers which are stacked is preferably one or two or more. In view of complexity of adjustment and downsizing of the hosel part, the number of the spacers which are stacked is preferably one or two.

FIG. 12 to FIG. 17 are plan views of an end surface (lower end surface) of the tip engagement part. Changes in the position and the direction of the centerline of the shaft will be explained using these plan views.

In FIG. 12 to FIG. 17, the following abbreviations are used.

LI: lie angle
LF: loft angle
FP: face progression
DC: distance of the center of gravity
L: large
M: medium
S: small FIG. 12 to FIG. 15 are plan views of the lower end surface in an embodiment A in which the number of the spacers is one. In this embodiment, a sleeve sv1 and a spacer sp1 are used. A position Zs of the center line of the shaft at the lower end of the hosel hole is shown by the intersection point of solid lines. The intersection point of one-dot chain lines shows a position of the center line of the shaft at the upper end of the hosel hole. In this embodiment, the position of the center line of the shaft at the upper end of the hosel hole is not changed regardless of the rotation positions of the sleeve sv1 and the spacer sp1.

The embodiment A shown in FIG. 12 to FIG. 15 satisfies the following (A1) and (A2).

(A1) A center line of an inner surface of the sleeve sv1 (that is, the center line of the shaft) is inclined with respect to a center line of an outer surface of the sleeve sv1.

(A2) A center line of an inner surface of the spacer sp1 is inclined with respect to a center line of an outer surface of the spacer sp1.

In the embodiment A, the outer surface of the sleeve sv1 is a four-sided pyramid surface, each of the inner surface and the outer surface of the spacer sp1 is also a four-sided pyramid surface, and a reverse-tapered hole is also a four-sided pyramid surface. Therefore, the number of the rotation positions of the sleeve sv1 is four, and the number of the rotation positions of the spacer sp1 is also four. In the embodiment A, the number of kinds of combinations of the rotation positions of the sleeve sv1 and the rotation positions of the spacer sp1 is: 4×4=16. A golf club according to the embodiment A is excellent in degree of freedom of adjustment. FIG. 12 to FIG. 15 show all the 16 kinds of combinations.

Figure 12:
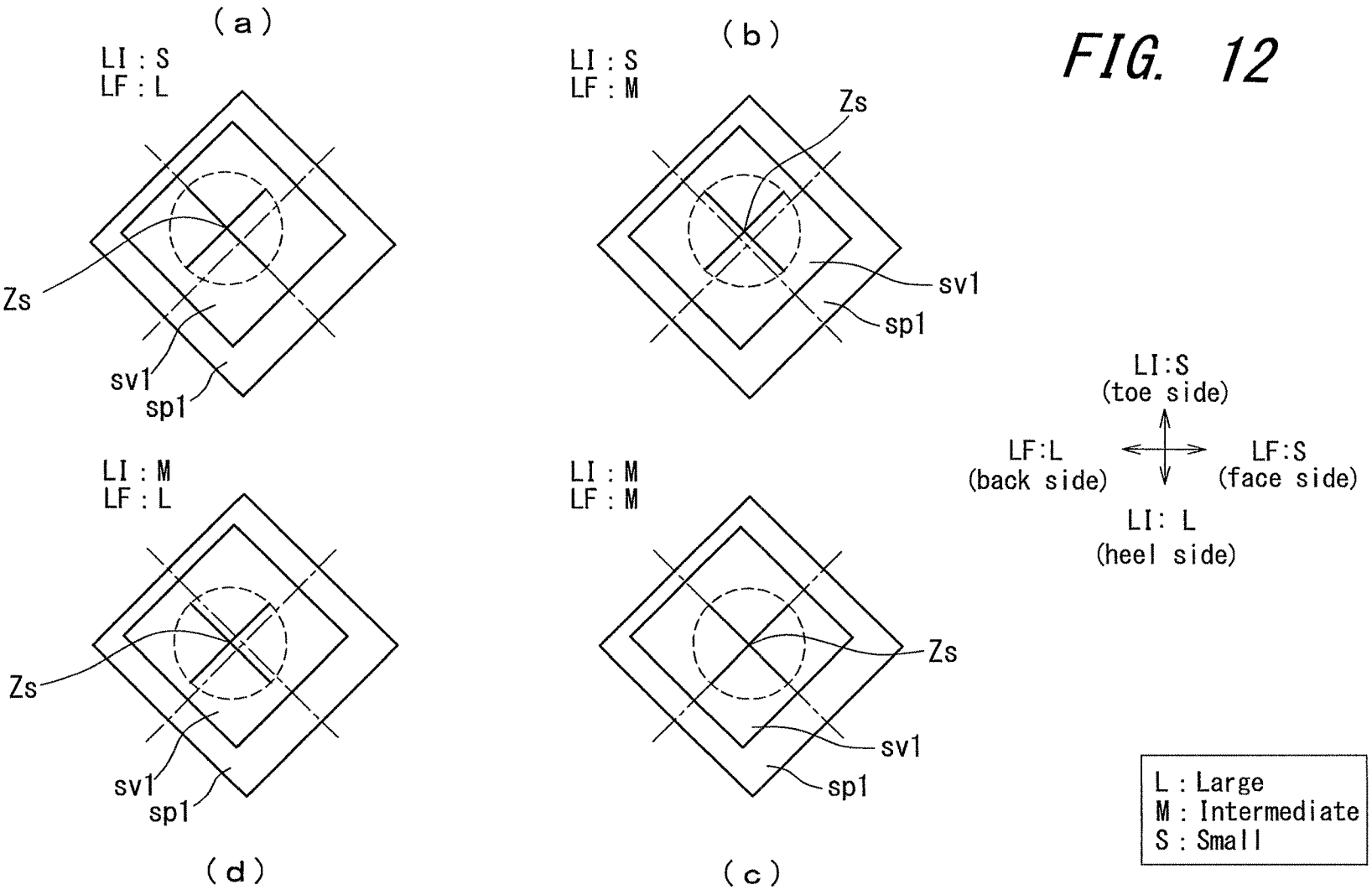
FIG. 12 is plan views of a lower end surface of the tip engagement part, and shows variations of a position of a center line of the shaft.

In symbol (a) of FIG. 12, the rotation position of the sleeve sv1 is a first position, and the rotation position of the spacer sp1 is a first position. In symbol (b) of FIG. 12, the rotation position of the sleeve sv1 is a second position, and the rotation position of the spacer sp1 is the first position. In symbol (c) of FIG. 12, the rotation position of the sleeve sv1 is a third position, and the rotation position of the spacer sp1 is the first position. In symbol (d) of FIG. 12, the rotation position of the sleeve sv1 is a fourth position, and the rotation position of the spacer sp1 is the first position.

Figure 13:
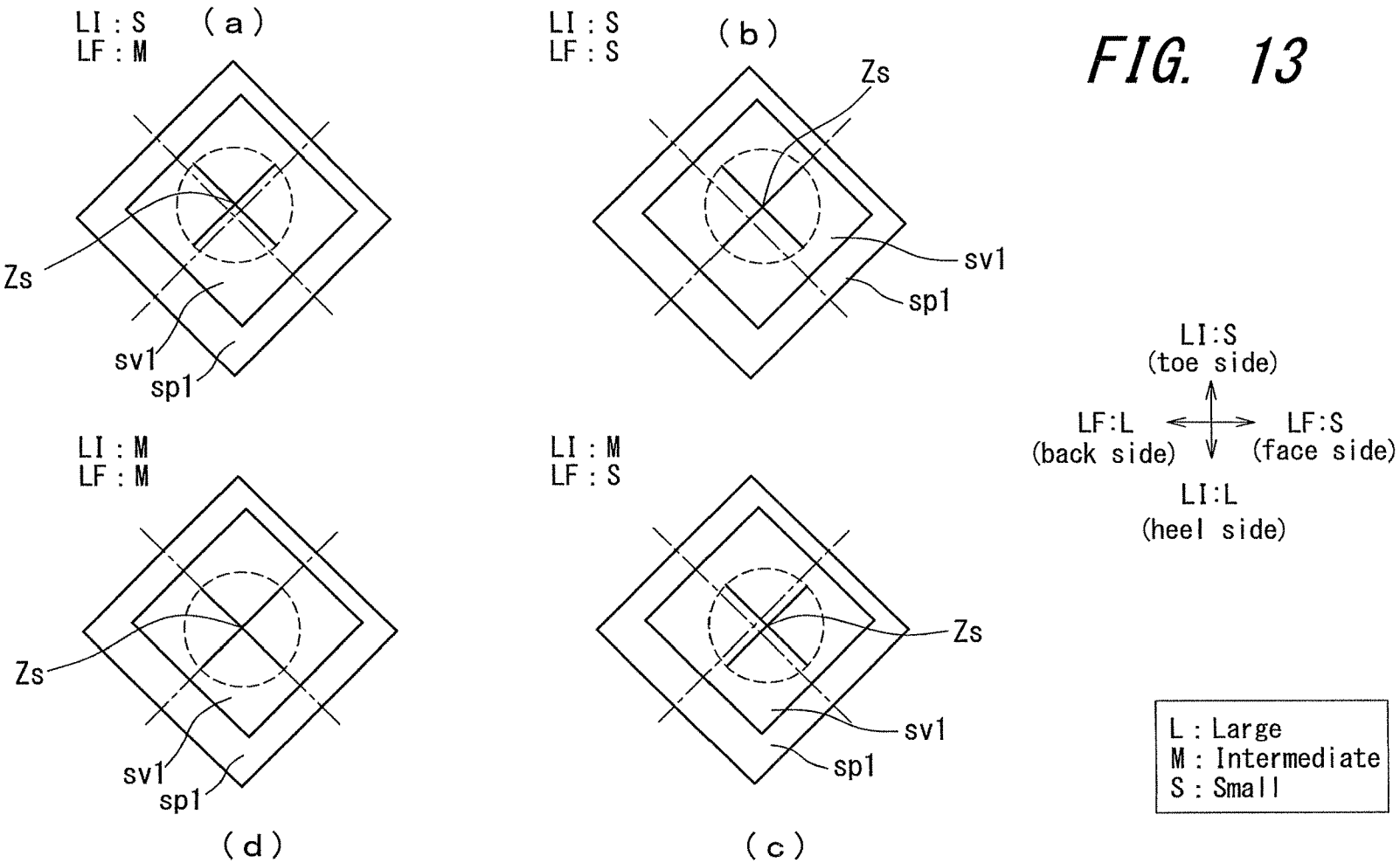

In symbol (a) of FIG. 13, the rotation position of the sleeve sv1 is the first position, and the rotation position of the spacer sp1 is a second position. In symbol (b) of FIG. 13, the rotation position of the sleeve sv1 is the second position, and the rotation position of the spacer sp1 is the second position. In symbol (c) of FIG. 13, the rotation position of the sleeve sv1 is the third position, and the rotation position of the spacer sp1 is the second position. In symbol (d) of FIG. 13, the rotation position of the sleeve sv1 is the fourth position, and the rotation position of the spacer sp1 is the second position.

Figure 14:
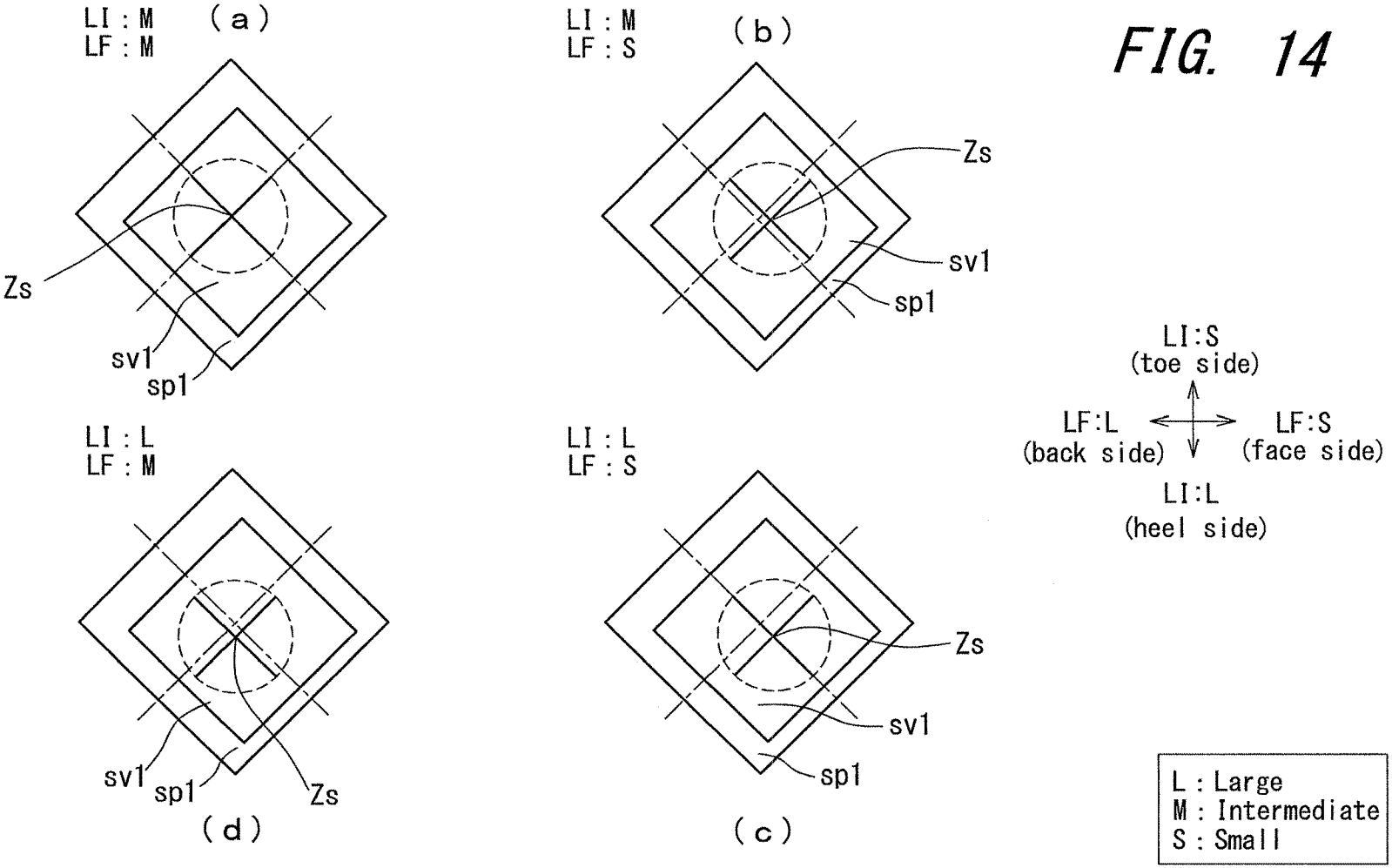

In symbol (a) of FIG. 14, the rotation position of the sleeve sv1 is the first position, and the rotation position of the spacer sp1 is a third position. In symbol (b) of FIG. 14, the rotation position of the sleeve sv1 is the second position, and the rotation position of the spacer sp1 is the third position. In symbol (c) of FIG. 14, the rotation position of the sleeve sv1 is the third position, and the rotation position of the spacer sp1 is the third position. In symbol (d) of FIG. 14, the rotation position of the sleeve sv1 is the fourth position, and the rotation position of the spacer sp1 is the third position.

Figure 15:
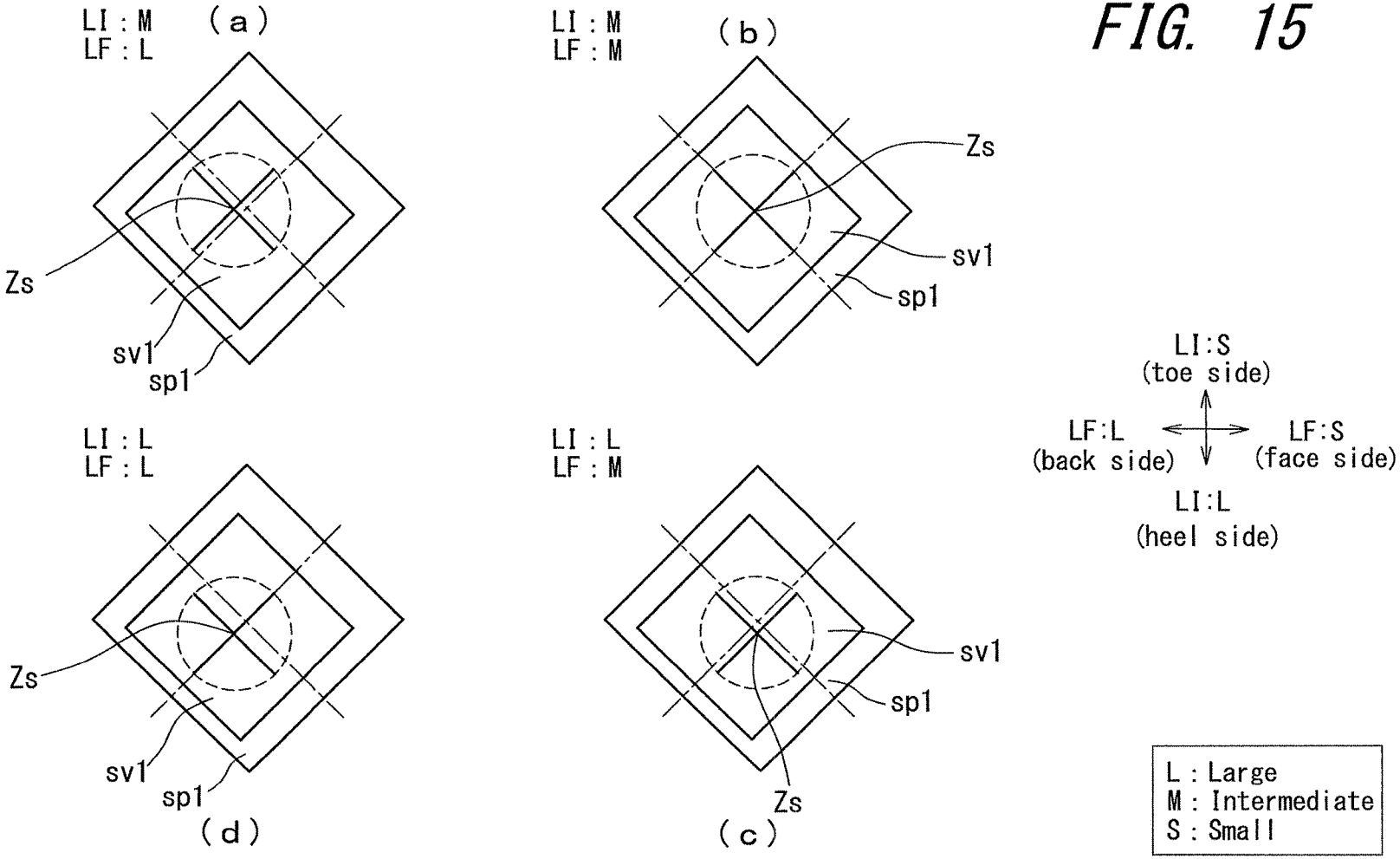

In symbol (a) of FIG. 15, the rotation position of the sleeve sv1 is the first position, and the rotation position of the spacer sp1 is a fourth position. In symbol (b) of FIG. 15, the rotation position of the sleeve sv1 is the second position, and the rotation position of the spacer sp1 is the fourth position. In symbol (c) of FIG. 15, the rotation position of the sleeve sv1 is the third position, and the rotation position of the spacer sp1 is the fourth position. In symbol (d) of FIG. 15, the rotation position of the sleeve sv1 is the fourth position, and the rotation position of the spacer sp1 is the fourth position.

These 16 kinds of combinations include 9 kinds of positions Zs. That is, the center line of the shaft can take nine different positions.

In FIG. 12 to FIG. 15, the transverse direction of the drawing is a face-back direction. The right side of the drawing is a face side, and the left side of the drawing is a back side. As the position Zs is closer to the rightmost side, the loft angle is smaller. As the position Zs is closer to the leftmost side, the loft angle is larger. The golf club according to the present embodiment is right-handed.

In FIGS. 12 to 15, the lengthwise direction of the drawing is a toe-heel direction. The upper side of the drawing is a toe side, and the lower side of the drawing is a heel side. As the position Zs is closer to the uppermost side, the lie angle is smaller. As the position Zs is closer to the lowermost side, the lie angle is larger.

According to the 9 kinds of positions of the center line of the shaft, specifications of the combinations of the loft angles and the lie angles are the following 9 kinds.

(Specification 1) The lie angle is small and the loft angle is small.

(Specification 2) The lie angle is small and the loft angle is medium.

(Specification 3) The lie angle is small and the loft angle is large.

(Specification 4) The lie angle is medium and the loft angle is small.

(Specification 5) The lie angle is medium and the loft angle is medium.

(Specification 6) The lie angle is medium and the loft angle is large.

(Specification 7) The lie angle is large and the loft angle is small.

(Specification 8) The lie angle is large and the loft angle is medium.

(Specification 9) The lie angle is large and the loft angle is large.

In the golf club according to the embodiment A, an independent variability of the loft angle is achieved. In the golf club according to the embodiment A, an independent variability of the lie angle is achieved. In the embodiment A, the direction (phase) of the reverse-tapered hole (hosel hole) is set so that the independent variability of the loft angle and the independent variability of the lie angle are achieved.

For example, among the specifications 1, 2, and 3, the loft angle is changed without changing the lie angle. This is one example of the independent variability of the loft angle. The same independent variability is provided also among the specifications 4, 5, and 6. The same independent variability is provided also among the specifications 7, 8, and 9.

For example, among the specifications 1, 4, and 7, the lie angle is changed without changing the loft angle. This is one example of the independent variability of the lie angle. The same independent variability is provided also among the specifications 2, 5, and 8. The same independent variability is provided also among the specifications 3, 6, and 9.

The independent variability of the loft angle means that the loft angle is changed without substantially changing the lie angle. The phrase "without substantially changing" means that change in the lie angle is equal to or less than 20% based on the amount of change in the loft angle. The independent variability of the lie angle means that the lie angle is changed without substantially changing the loft angle. The phrase "without substantially changing" means that change in the loft angle is equal to or less than 20% based on the amount of change in the lie angle.

Figure 16:
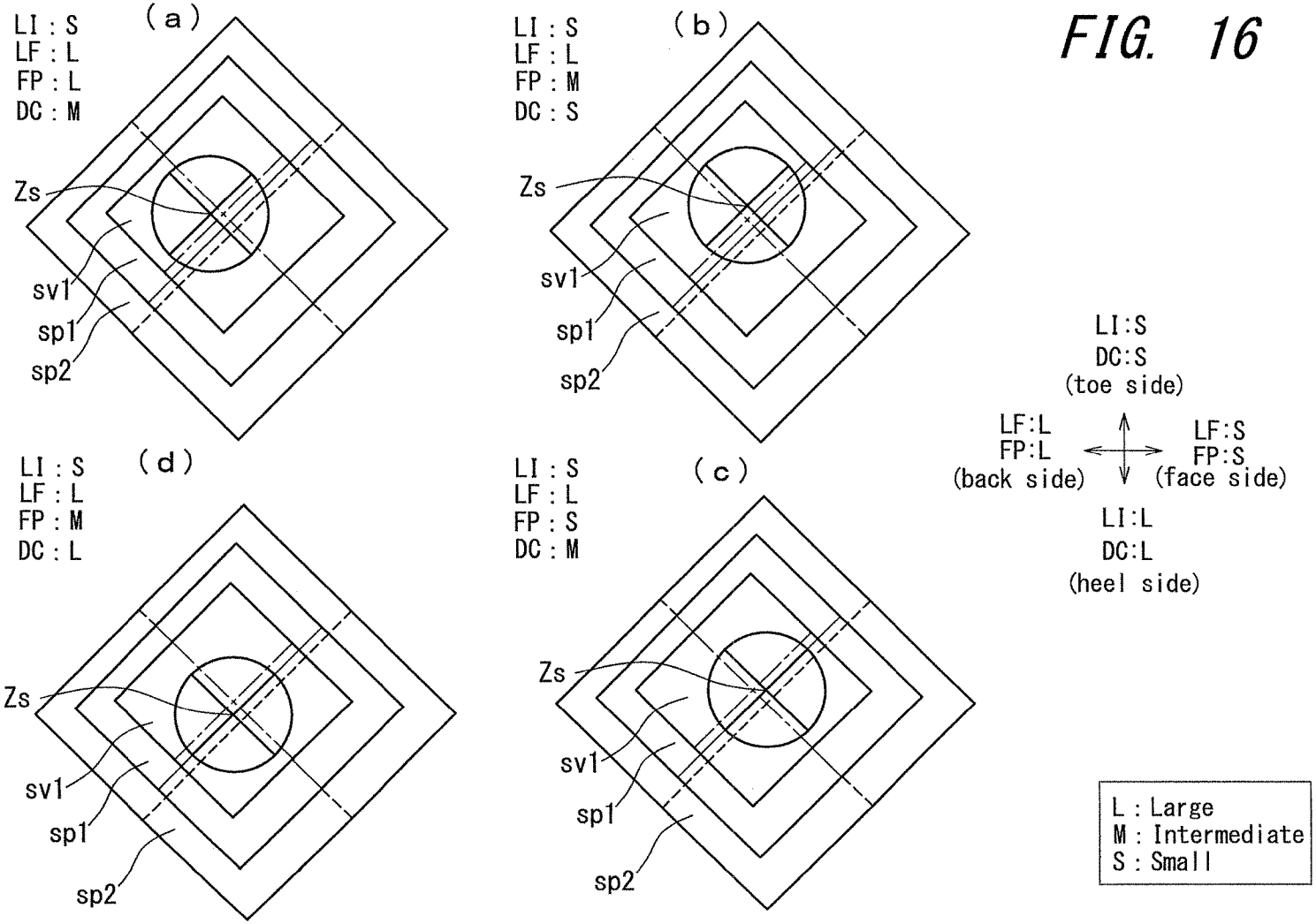
FIG. 16 is plan views of the lower end surface of the tip engagement part, and shows variations of the position of the center line of the shaft.
Figure 17:
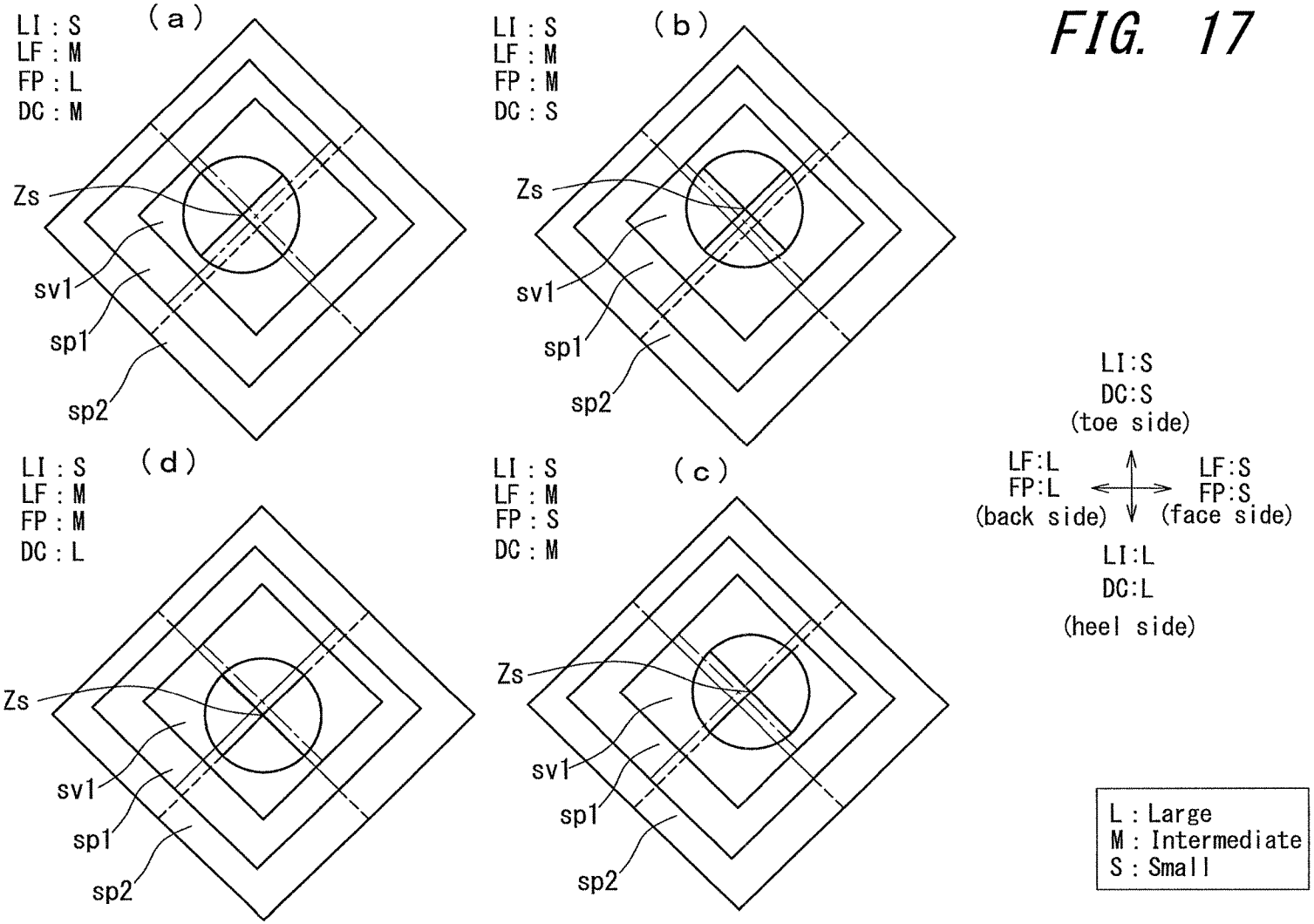

FIG. 16 and FIG. 17 are plan views of the lower end surface of an embodiment B in which the number of the spacers is 2 (double-layered). In the present embodiment, a sleeve sv1, a first spacer sp1, and a second spacer sp2 are used. A position Zs of the center line of the shaft at the lower end of the hosel hole is shown by the intersection point of thick solid lines. The intersection point of one-dot chain lines shows the position of the center line of the outer surface of the sleeve sv1 at the lower end of the hosel hole. The intersection point of thin solid lines shows the position of the center line of the outer surface of the spacer sp1 at the lower end of the hosel hole. The intersection point of dashed lines shows the position of the center line of the outer surface of the spacer sp2 at the lower end of the hosel hole. Regardless of the rotation positions of the sleeve sv1, the spacer sp1, and the spacer sp2, the three center lines cross at one point at the position of the upper end of the hosel hole.

In the embodiment B, the outer surface of the sleeve sv1 is a four-sided pyramid surface. Each of inner and outer surfaces of the first spacer sp1 is also a four-sided pyramid surface, and each of inner and outer surfaces of the second spacer sp2 is also a four-sided pyramid surface. A reverse-tapered hole is also a four-sided pyramid surface. Therefore, the number of the rotation positions of the sleeve sv1 is four, the number of the rotation positions of the first spacer sp1 is also four, and the number of the rotation positions of the second spacer sp2 is also four. In the embodiment B, the number of kinds of combinations of the three members' rotation positions is $4\times4\times4=64$. A golf club according to the embodiment B has an excellent degree of freedom of adjustment.

The embodiment B shown in FIG. 16 and FIG. 17 satisfies the following (B1) to (B3).

(B1) A center line of an inner surface of the sleeve sv1 (that is, the center line of the shaft) is parallel and eccentric to a center line of the outer surface of the sleeve sv1.

(B2) A center line of the inner surface of the first spacer sp1 is inclined with respect to a center line of the outer surface of the first spacer sp1.

(B3) A center line of the inner surface of the second spacer sp2 is inclined with respect to a center line of the outer surface of the second spacer sp2.

The phrase "parallel and eccentric" means eccentricity in which center lines are parallel to each other.

The relation between the first spacer sp1 and the second spacer sp2 in the embodiment B is the same as the relation between the sleeve sv1 and the spacer sp1 in the above-mentioned embodiment A. Therefore, 9 kinds of combinations of the loft angles and the lie angles are achieved by the first spacer sp1 and the second spacer sp2. Furthermore, in the embodiment B, adjustment because of the sleeve sv1 is added. Since the sleeve sv1 is parallel and eccentric, each of the nine positions of the shaft axis can be further moved in parallel. The parallel movement of the shaft axis can change face progression. The parallel movement can achieve the movement of the shaft axis in the face-back direction. Furthermore, the parallel movement can achieve the movement of the shaft axis in the toe-heel direction. In the embodiment B, the degree of freedom of adjustment of the shaft axis is further improved by the two spacers.

FIG. 16 and FIG. 17 show only eight kinds of the above-mentioned 64 kinds.

In symbols (a) to (d) in FIG. 16, the rotation position of the first spacer sp1 is a first position, and the rotation position of the second spacer sp2 is also the first position. In symbols (a) to (d) in FIG. 16, only the rotation position of the sleeve sv1 is changed without changing the rotation positions of the first spacer sp1 and the second spacer sp2. In symbol (a) in FIG. 16, the rotation position of the sleeve sv1 is a first position. In symbol (b) FIG. 16, the rotation position of the sleeve sv1 is a second position. In symbol (c) in FIG. 16, the rotation position of the sleeve sv1 is a third position. In symbol (d) in FIG. 16, the rotation position of the sleeve sv1 is a fourth position.

In symbols (a) to (d) in FIG. 17, the rotation position of the first spacer sp1 is the second position, and the rotation position of the second spacer sp2 is the first position. Also in symbols (a) to (d) in FIG. 17, only the rotation position of the sleeve sv1 is changed without changing the rotation positions of the first spacer sp1 and the second spacer sp2. In symbol (a) in FIG. 17, the rotation position of the sleeve sv1 is the first position. In symbol (b) in FIG. 17, the rotation position of the sleeve sv1 is the second position. In symbol (c) in FIG. 17, the rotation position of the sleeve sv1 is the third position. In symbol (d) in FIG. 17, the rotation position of the sleeve sv1 is the fourth position.

In comparison of FIG. 16 with FIG. 17, in symbols (a) to (d) in FIG. 16, the rotation position of the first spacer sp1 is the first position, in contrast, in symbols (a) to (d) in FIG. 17, the rotation position of the first spacer sp1 is the second position. Because of the difference, the loft angle in each of symbols (a) to (d) in FIG. 17 is decreased to medium as compared with large loft angle of each of symbols (a) to (d) in FIG. 16.

In symbols (a) to (d) in FIG. 16, the rotation position of the sleeve sv1 changes from the first position to the fourth position. Because of the change, face progression (FP) which is an index showing the position of the center line of the shaft in the face-back direction changes in order of large (L), medium (M), small (S), and medium (M). Simultaneously, the distance of the center of gravity which is an index showing the position of the center line of the shaft in the toe-heel direction changes in order of medium (M), small (S), medium (M), and large (L). The distance of the center of gravity is a distance between the center of gravity of the head and the center line of the shaft. The distance is measured in an image projected to a plane which is parallel to the toe-heel direction and includes the center line of the shaft.

Therefore, for example, in comparison between symbol (a) and symbol (c) in FIG. 16, the position of the center line of the shaft (the position of the center line of the shaft at the upper end of the hosel hole) moves in the face-back direction while maintaining the inclination of the center line of the shaft so that the lie angle is small and the loft angle is large. In addition, in symbol (a) and symbol (c) of FIG. 16, the distance of the center of gravity is medium without change.

In comparison between symbol (b) and symbol (d) in FIG. 16, the position of the center line of the shaft (the position of the center line of the shaft at the upper end of the hosel hole) moves in the toe-heel direction while maintaining the inclination of the center line of the shaft so that the lie angle is small and the loft angle is large. In addition, in symbol (b) and symbol (d) of FIG. 16, the face progression is medium without change.

Also in symbols (a) to (d) in FIG. 17, the rotation position of the sleeve sv1 changes from the first position to the fourth position. Because of the change, the face progression changes in order of large, medium, small, and medium. Simultaneously, the distance of the center of gravity changes in order of medium, small, medium, and large.

Therefore, for example, in comparison between symbol (a) and symbol (c) in FIG. 17, the position of the center line of the shaft (the position of the center line of the shaft at the upper end of the hosel hole) moves in the face-back direction while maintaining the inclination of the center line of the shaft so that the lie angle is small and the loft angle is medium. In addition, in symbol (a) and symbol (c) of FIG. 17, the distance of the center of gravity is medium without change.

In comparison between symbol (b) and symbol (d) in FIG. 17, the position of the center line of the shaft (the position of the center line of the shaft at the upper end of the hosel hole) moves in the toe-heel direction while maintaining the inclination of the center line of the shaft so that the lie angle is small and the loft angle is medium. In addition, in symbol (b) and symbol (d) of FIG. 17, the face progression is medium without change.

Although the axis displacement of the sleeve sv1 is parallel eccentricity in the present embodiment, the axis displacement may be naturally inclination, for example. Of course, parallel eccentricity may be adopted for the spacer.

As shown in FIG. 12 to FIG. 17, the position of the center line of the shaft on the sole side can be variously changed. Since the present embodiment eliminates the need for screw fixation, the degrees of freedom of the position and the inclination of the center line of the shaft are high. Therefore, the range of angle adjustment can be increased. The range of adjustment for the loft angle, the lie angle, the face angle, the face progression, etc., can be increased.

Figure 18:
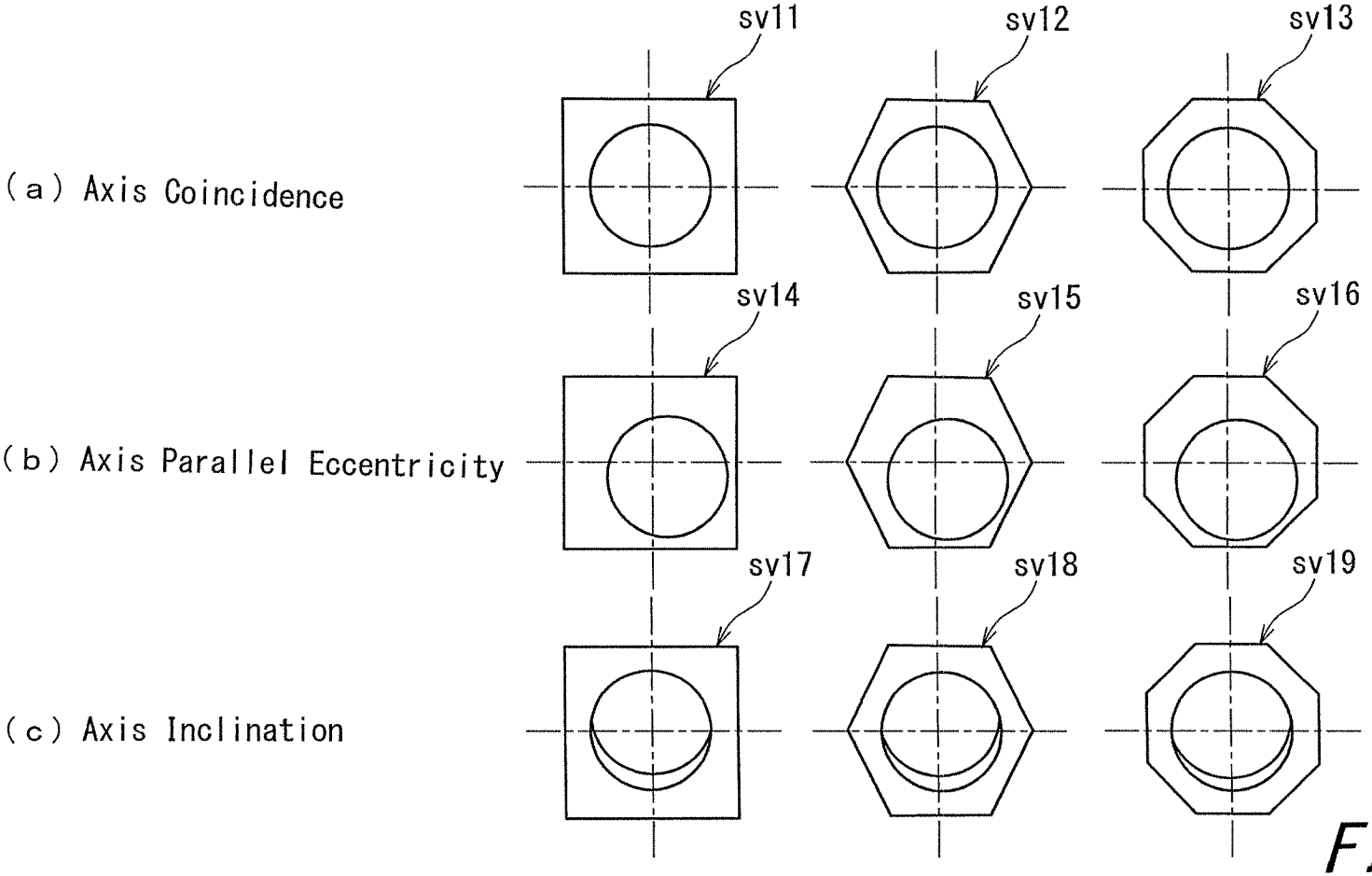
FIG. 18 is plan views of nine sleeves.

Each of nine drawings shown in FIG. 18 is a plan view (drawing viewed from above) of the sleeve which can be applied to the present embodiment. In FIG. 18, examples of the sectional shape of the outer surface of the sleeve include a tetragon (square), a hexagon (regular hexagon), and an octagon (regular octagon). Axis coincidence, axis parallel eccentricity, and axis inclination are shown as the form of the axis displacement of the sleeve in FIG. 18.

In a sleeve sv11, the sectional shape of the outer surface of the sleeve is tetragon (square); the outer surface of the sleeve is a four-sided pyramid surface; and the center line of the inner surface of the sleeve (the center line of the shaft) coincides with the center line of the outer surface of the sleeve. In a sleeve sv12, the sectional shape of the outer surface of the sleeve is a hexagon (regular hexagon); the outer surface of the sleeve is a six-sided pyramid surface; and the center line of the inner surface of the sleeve (the center line of the shaft) coincides with the center line of the outer surface of the sleeve. In a sleeve sv13, the sectional shape of the outer surface of the sleeve is an octagon (regular octagon); the outer surface of the sleeve is an eight-sided pyramid surface; and the center line of the inner surface of the sleeve (the center line of the shaft) coincides with the center line of the outer surface of the sleeve.

In a sleeve sv14, the sectional shape of the outer surface of the sleeve is a tetragon (square); the outer surface of the sleeve is a four-sided pyramid surface; and the center line of the inner surface of the sleeve (the center line of the shaft) is parallel and eccentric to the center line of the outer surface of the sleeve. In a sleeve sv15, the sectional shape of the outer surface of the sleeve is a hexagon (regular hexagon); the outer surface of the sleeve is a six-sided pyramid surface; and the center line of the inner surface of the sleeve (the center line of the shaft) is parallel and eccentric to the centerline of the outer surface of the sleeve. In a sleeve sv16, the sectional shape of the outer surface of the sleeve is an octagon (regular octagon); the outer surface of the sleeve is an eight-sided pyramid surface; and the center line of the inner surface of the sleeve (the center line of the shaft) is parallel and eccentric to the center line of the outer surface of the sleeve.

In a sleeve sv17, the sectional shape of the outer surface of the sleeve is a tetragon (square); the outer surface of the sleeve is a four-sided pyramid surface; and the center line of the inner surface of the sleeve (the center line of the shaft) is inclined with respect to the center line of the outer surface of the sleeve. In a sleeve sv18, the sectional shape of the outer surface of the sleeve is a hexagon (regular hexagon); the outer surface of the sleeve is a six-sided pyramid surface; and the center line of the inner surface of the sleeve (the center line of the shaft) is inclined with respect to the center line of the outer surface of the sleeve. In a sleeve sv19, the sectional shape of the outer surface of the sleeve is an octagon (regular octagon); the outer surface of the sleeve is an eight-sided pyramid surface; and the center line of the inner surface of the sleeve (the center line of the shaft) is inclined with respect to the center line of the outer surface of the sleeve.

Thus, various sleeves may be used. Of course, these sleeves shown in FIG. 18 are merely exemplified. Similarly, various forms may be adopted also for the spacer.

From the viewpoint of preventing an excessively large hosel, the amount of eccentricity of parallel eccentricity in the sleeve is preferably equal to or less than 5 mm, more preferably equal to or less than 2 mm, and still more preferably equal to or less than 1.5 mm. From the viewpoint of adjusting properties, the amount of eccentricity of parallel eccentricity in the sleeve is preferably equal to or greater than 0.5 mm, and more preferably equal to or greater than 1.0 mm.

From the viewpoint of preventing an excessively large hosel, the inclination angle θ1 of the center line of the shaft with respect to the center line of the outer surface of the sleeve is preferably equal to or less than 5 degrees, more preferably equal to or less than 3 degrees, and still more preferably equal to or less than 2 degrees. From the viewpoint of adjusting properties, the inclination angle θ1 is preferably equal to or greater than 0.5 degrees, more preferably equal to or greater than 1 degree, and still more preferably equal to or greater than 1.5 degrees.

From the viewpoint of preventing an excessively large hosel, the amount of eccentricity of parallel eccentricity in the spacer is preferably equal to or less than 5 mm, more preferably equal to or less than 2 mm, and still more preferably equal to or less than 1.5 mm. From the viewpoint of adjusting properties, the amount of eccentricity of parallel eccentricity in the spacer is preferably equal to or greater than 0.5 mm, and more preferably equal to or greater than 1.0 mm.

From the viewpoint of preventing an excessively large hosel, the inclination angle θ2 of the center line of the inner surface of the spacer with respect to the center line of the outer surface of the spacer is preferably equal to or less than 5 degrees, more preferably equal to or less than 3 degrees, and still more preferably equal to or less than 2 degrees. From the viewpoint of adjusting properties, the inclination angle θ2 is preferably equal to or greater than 0.5 degrees, more preferably equal to or greater than 1 degree, and still more preferably equal to or greater than 1.5 degrees.

Figure 19:
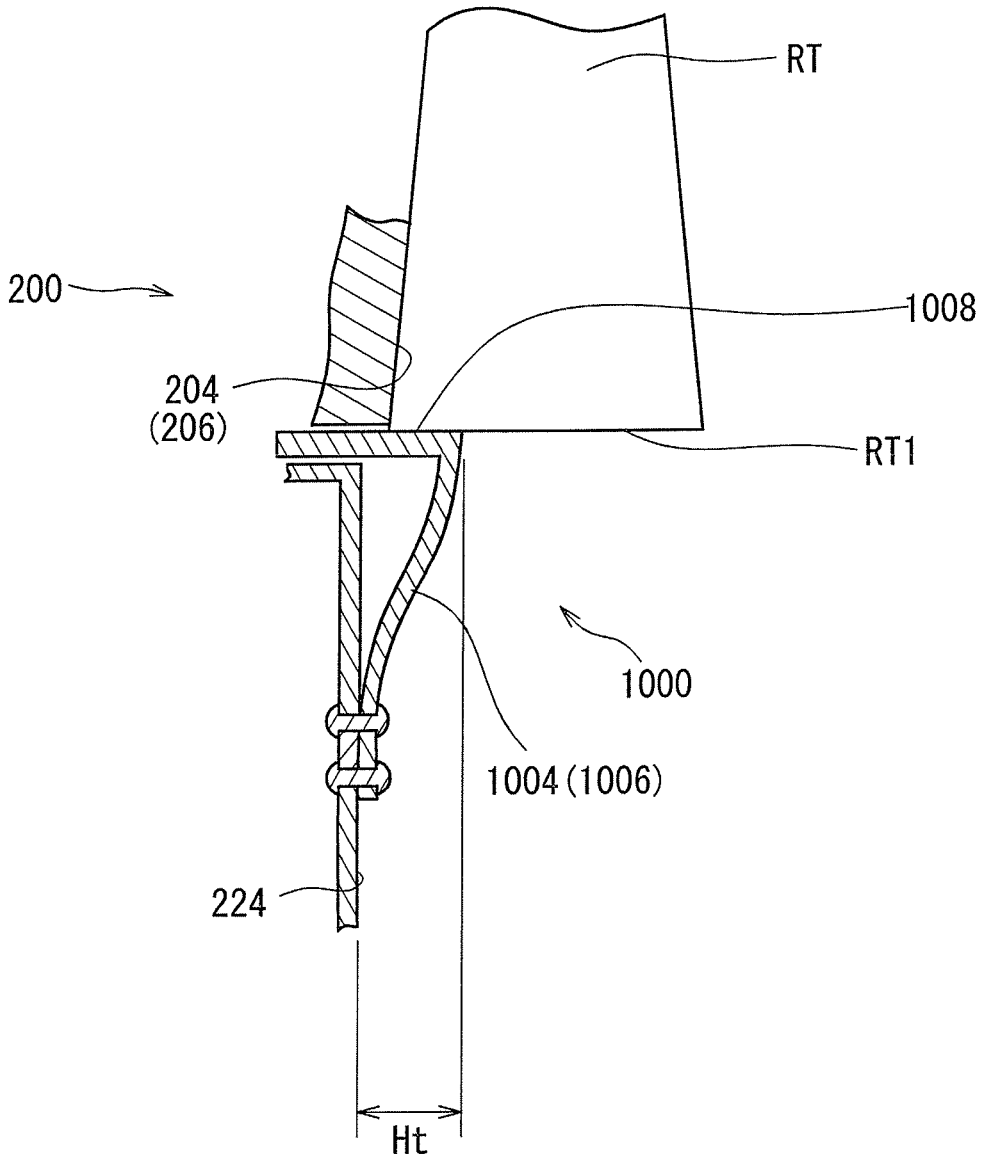
FIG. 19 is a sectional view showing an example of a falling-off prevention mechanism.

FIG. 19 is a sectional view of the vicinity of a falling-off prevention mechanism 1000 provided on the head 200. FIG. 19 is turned upside down relative to FIG. 2.

The falling-off prevention mechanism 1000 has an elastic projection 1004 biased in a projecting direction under a state where the elastic projection 1004 can project and retract. In the present embodiment, the elastic projection 1004 is a plate spring 1006. FIG. 19 is a sectional view of the falling-off prevention mechanism 1000 in a natural state where an external force does not act thereon. In the natural state, the plate spring 1006 is configured such that a projection height Ht of the plate spring 1006 from an installation surface 224 is increased toward the reverse-tapered hole 206. In the natural state, the falling-off prevention mechanism 1000 has an abutting surface 1008 which abuts on the end surface (lower end surface) of the tip engagement part fitted to the reverse-tapered hole 206.

The abutting surface 1008 of the falling-off prevention mechanism 1000 abuts on the lower end surface of the spacer 500, and the lower end surface of the sleeve 400. A lower end surface RT1 of the tip engagement part RT includes the lower end surface of the spacer 500 and the lower end surface of the sleeve 400. The abutting surface 1008 abuts on the lower end surface RT1.

Thus, the falling-off prevention mechanism 1000 abuts on the sleeve (including an extension sleeve) and the spacer. For this reason, the moving of the tip engagement part RT in an engagement releasing direction is regulated. As a result, falling off of the tip engagement part RT is prevented. That is, falling off of the shaft 300 is prevented.

When the plate spring 1006 is pressed, the plate spring 1006 retracts such that the projection height Ht decreases. By the retracting, the abutting surface 1008 is housed inside the head 200. As a result, the abutting surface 1008 becomes unable to abut on the lower end surface of the tip engagement part RT. In this state, the tip engagement part RT can be moved in the engagement releasing direction. Therefore, the shaft 300 can be detached from the head 200.

In the above-described step (d) (see FIG. 4), the tip engagement part RT moves toward the reverse-tapered hole 206, while pressing the plate spring 1006. The pressed plate spring 1006 retracts to allow the tip engagement part RT to move as described above. When the tip engagement part RT reaches a position where the tip engagement part RT abuts on (is engaged with) the reverse-tapered hole 206, the tip engagement part RT no longer presses the plate spring 1006 and the plate spring 1006 is projected. As a result, the abutting surface 1008 abuts on the lower end surface RT1 of the tip engagement part RT, and thereby the falling-off prevention mechanism 1000 fulfills function thereof.

For releasing the function of the falling-off prevention mechanism 1000, press the plate spring 1006 by external force to release the abutting between the abutting surface 1008 and the lower end surface RT1. The external force is applied by a person's finger, for example.

Figure 20:
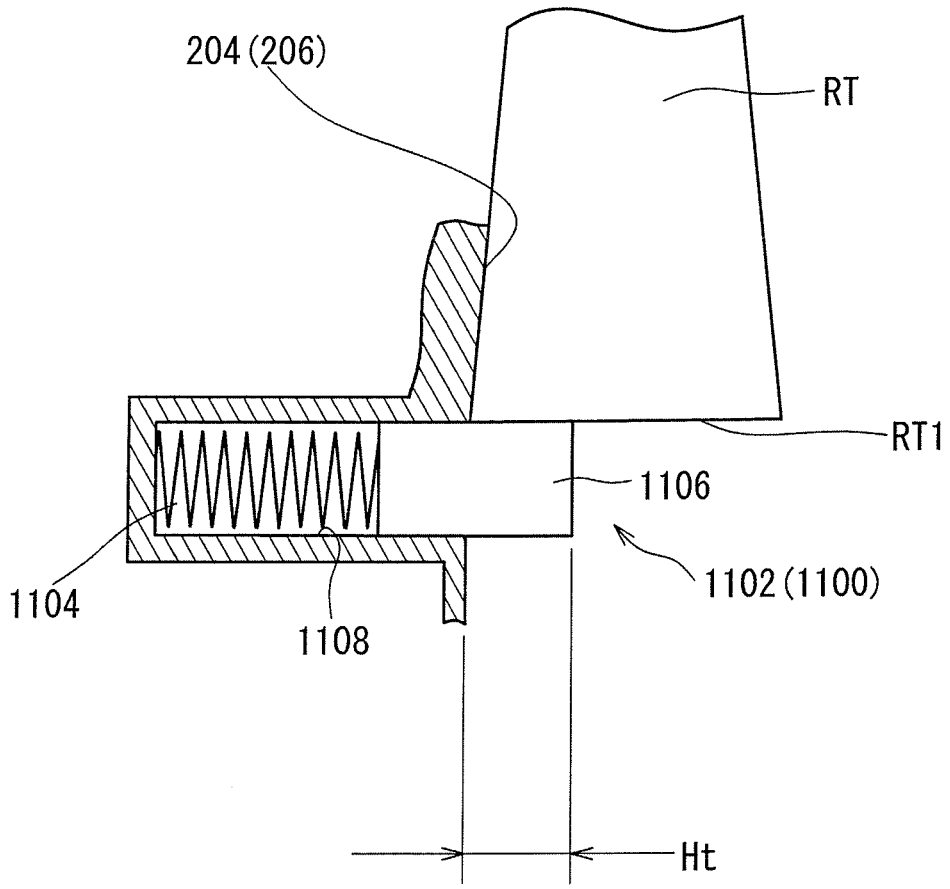
FIG. 20 is a sectional view showing another example of the falling-off prevention mechanism.

FIG. 20 is a sectional view of a falling-off prevention mechanism 1100 according to a modification example. The falling-off prevention mechanism 1100 has an elastic projection 1102 biased in a projecting direction under a state where the elastic projection 1102 can project and retract. The elastic projection 1102 has a compression spring 1104, a sliding member 1106, and a sliding hole 1108. The sliding member 1106 is a cylindrical member, for example. The sliding hole 1108 is a circular hole, for example.

The compression spring 1104 biases the sliding member 1106 in a projecting direction. In a natural state where external force does not act, the sliding member 1106 is located at a position where the sliding member 1106 abuts on the lower end surface RT1. FIG. 20 shows the natural state. When the sliding member 1106 is pressed, the sliding member 1106 retracts such that a projection height Ht of the sliding member 1106 decreases. By the retracting, engagement of the sliding member 1106 and the lower end surface RT1 is released. Thus, the function of the falling-off prevention mechanism 1100 is the same as that of the falling-off prevention mechanism 1000.

Other examples of the falling-off prevention mechanism include a detachable member which is detachably attached. In a golf club head in the engagement state, the detachable member is attached to a position where the detachable member abuts on the lower end surface RT1. An attaching/detaching mechanism shown in JP2013-123439 is exemplified as an attaching/detaching mechanism including such a detachable member. A weight body shown in this gazette may be applied to the detachable member. For example, a structure in which the detachable member in an attached state (the engaging position) is projected from the head body, and the projected portion abuts on the lower end surface RT1 can be adopted. A screw member is also exemplified as another detachable member.

Figure 21A:
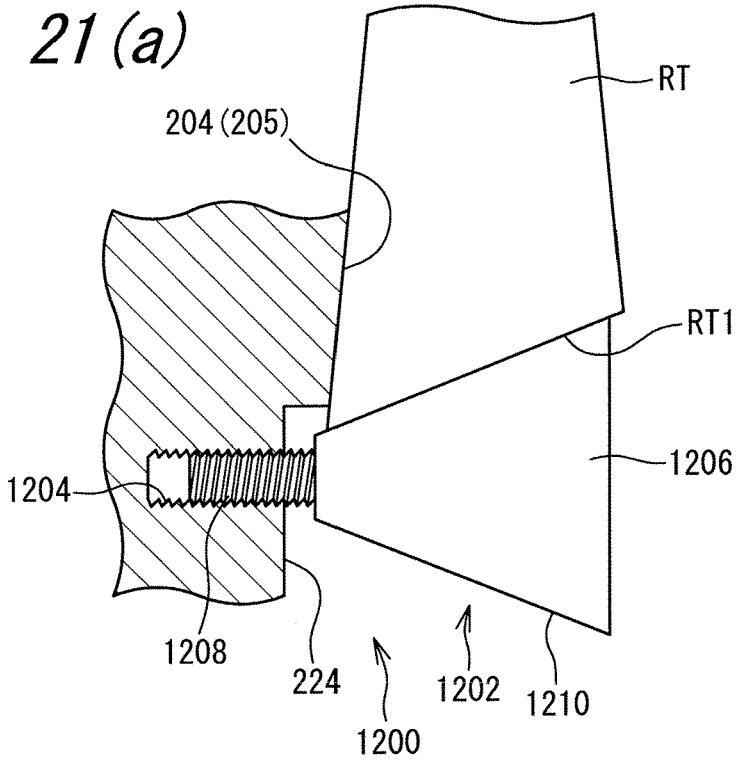
FIG. 21(*a*) and FIG. 21(*b*) are sectional views showing other examples of the falling-off prevention mechanism.
Figure 21B:
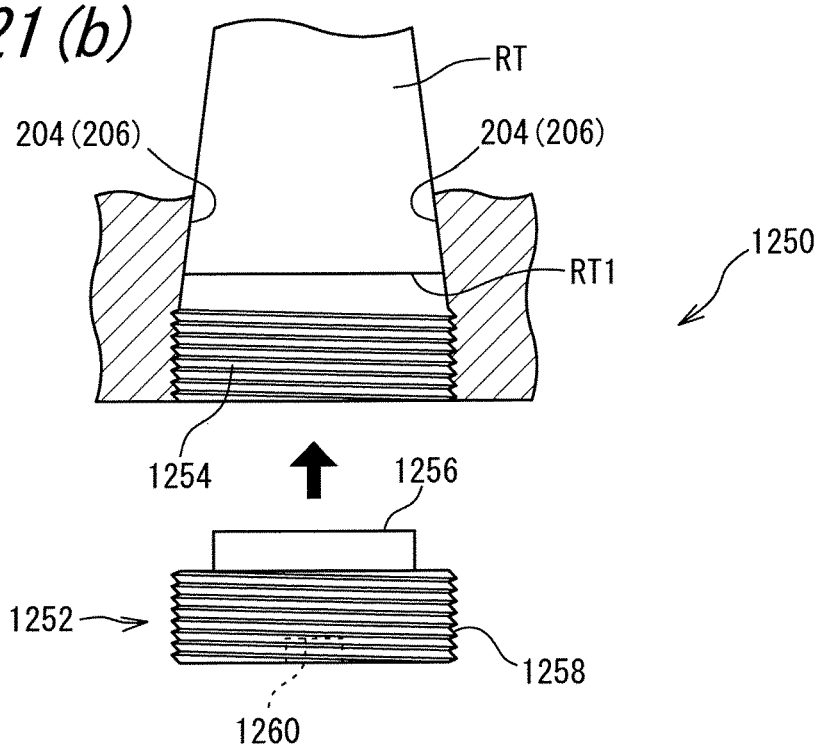

FIG. 21(*a*) shows an example of the falling-off prevention mechanism using a screw member. This falling-off prevention mechanism 1200 has a screw member 1202 and a screw hole 1204. The screw hole 1204 is provided on the installation surface 224. The screw member 1202 has a head part 1206 and a thread part 1208. A side surface 1210 of the head part 1206 has a tapered surface. The tapered surface 1210 is a conical surface (conically protruded surface). The tapered surface 1210 is coaxial with the thread part 1208. The tapered surface 1210 has an outer diameter which decreases toward the thread part 1208.

As shown in FIG. 21(*a*), the lower end surface RT1 of the tip engagement part RT has an inclined surface which can be bought into line-contact with the tapered surface 1210.

In a state where the thread part 1208 is screwed into the screw hole 1204, the inclined surface of the lower end surface RT1 is brought into line-contact with the tapered surface 1210. The tapered surface 1210 is shifted by a screwed amount of the thread part 1208, and, by the shift, a contact position of the tapered surface 1210 and the lower end surface RT1 is shifted in the axial direction of the shaft. In the falling-off prevention mechanism 1200, the contact position of the lower end surface RT1 and the screw member 1202 can be finely adjusted with the screwed amount of the screw member 1202.

The lower end surface RT1 may be brought into surface-contact with the screw member. For example, in the screw member 1202, a structure in which the thread part 1208 is rotatably supported by the head part 1206 can be adopted. For example, the head part 1206 may have a screw axis body having a thread part 1208 and a through hole, and a part of the screw axis body may be contained in the through hole. In the screw member, only the thread part 1208 can be rotated without rotating the head part 1206. For example, the lower end surface RT1 can be brought into surface-contact with the screw member if the side surface 1210 of the head part 1206 is a pyramid surface (four-sided pyramid surface).

FIG. 21(*b*) shows another example of the falling-off prevention mechanism using a screw member. This falling-off prevention mechanism 1250 has a screw member 1252 and a female screw part 1254. The female screw part 1254 is provided on the lower end portion of the hosel hole 204. A center line of the female screw part 1254 coincides with the center line of the tip engagement part RT. The screw member 1252 has an abutting surface 1256, a screw part 1258, and a rotating engagement part 1260. The abutting surface 1256 is an end surface (upper end surface) of the screw member 1252. The abutting surface 1256 is provided on a surface (upper surface) on one side of the screw part 1258. The rotating engagement part 1260 is provided on a surface (lower surface) on the other side of the screw part 1258.

The screw part 1258 of the screw member 1252 is screw-connected to the female screw part 1254. By the screw-connection, the screw member 1252 moves back and forth along the direction of the center line of the tip engagement part RT. When the screw member 1252 is screwed, the abutting surface 1256 approaches the lower end surface RT1 of the tip engagement part RT. When the screw member 1252 is further screwed, the abutting surface 1256 abuts on the lower end surface RT1. The screw member 1252 can push up the tip engagement part RT from the lower side. Falling off of the tip engagement part RT (shaft) is prevented by screwing the screw member 1252 until the abutting surface 1256 abuts on the lower end surface RT1.

A tool (wrench) for rotating the screw member 1252 is engaged with the rotating engagement part 1260. When the head includes a detachable weight member, the tool for rotating the screw member 1252 may be the same as a tool for attaching/detaching the weight member.

An engagement releasing direction and an engaging direction are defined in the present application. In the present application, the engagement releasing direction is a direction along the axial direction, and a direction in which the tip engagement part RT moves toward the sole side with respect to the reverse-tapered hole 206. In other words, the engagement releasing direction means a direction in which the reverse-tapered hole 206 moves toward the grip side with respect to the tip engagement part RT. If the tip engagement part RT is moved in the engagement releasing direction, the tip engagement part RT comes out of the reverse-tapered hole 206.

On the other hand, the engaging direction in the present application is a direction along the axial direction, and a direction in which the tip engagement part RT moves toward the grip side with respect to the reverse-tapered hole 206. In other words, the engaging direction means a direction in which the reverse-tapered hole 206 moves toward the sole side with respect to the tip engagement part RT.

In the golf club in the engagement state, the reverse-tapered fitting is formed between the tip engagement part RT and the reverse-tapered hole 206. A force in the engaging direction cannot release the reverse-tapered fitting, and on the contrary, enhances the contact pressure of the reverse-tapered fitting. The force in the engaging direction further ensures the engagement between the tip engagement part RT and the reverse-tapered hole 206.

A large force acting on the head is a centrifugal force during swinging, and an impact shock force upon impact. Among these, the centrifugal force is the above-mentioned force in the engaging direction. Because of a loft angle of the head, a component force of the impact shock force in the axial direction is also the force in the engaging direction. Therefore, the centrifugal force and the impact shock force cannot release the engagement between the tip engagement part RT and the reverse-tapered hole 206, and further ensures the engagement conversely. Since each of the tip engagement part RT and the reverse-tapered hole 206 has a non-circular sectional shape, relative rotation between the two cannot occur. As a result, although the tip engagement part RT and the reverse-tapered hole 206 are not fixed by an adhesive or the like, retention and anti-rotation required as a golf club are achieved. The structure of the reverse-tapered fitting can achieve both holding properties and attaching/detaching easiness.

Therefore, in the situation of a shot (swinging), the falling-off prevention mechanism is not necessarily needed.

Meanwhile, in situations other than swinging, a force in the engagement releasing direction may act on the golf club. Examples of the situations include a state where the golf club is inserted into a golf bag. In this state, the golf club is stood with the head up. In this case, the gravity acting on the head acts as the force in the engagement releasing direction. Even when the force in the engagement releasing direction acts under the presence of the falling-off prevention mechanism, the head does not fall off.

The force in the engagement releasing direction is smaller than the force in the engaging direction caused by the centrifugal force, the impact shock force, etc. Therefore, a large force does not act on the falling-off prevention mechanism. The falling-off prevention mechanism may be a simple mechanism. However, from the viewpoint of the Golf Rules, the falling-off prevention mechanism is preferably configured so as not to be released by bare hands. From the viewpoint of the Golf Rules, it is preferable that a special tool is required for the falling-off prevention mechanism.

The golf club of the present embodiment can have a club length adjustment mechanism.

Figure 22:
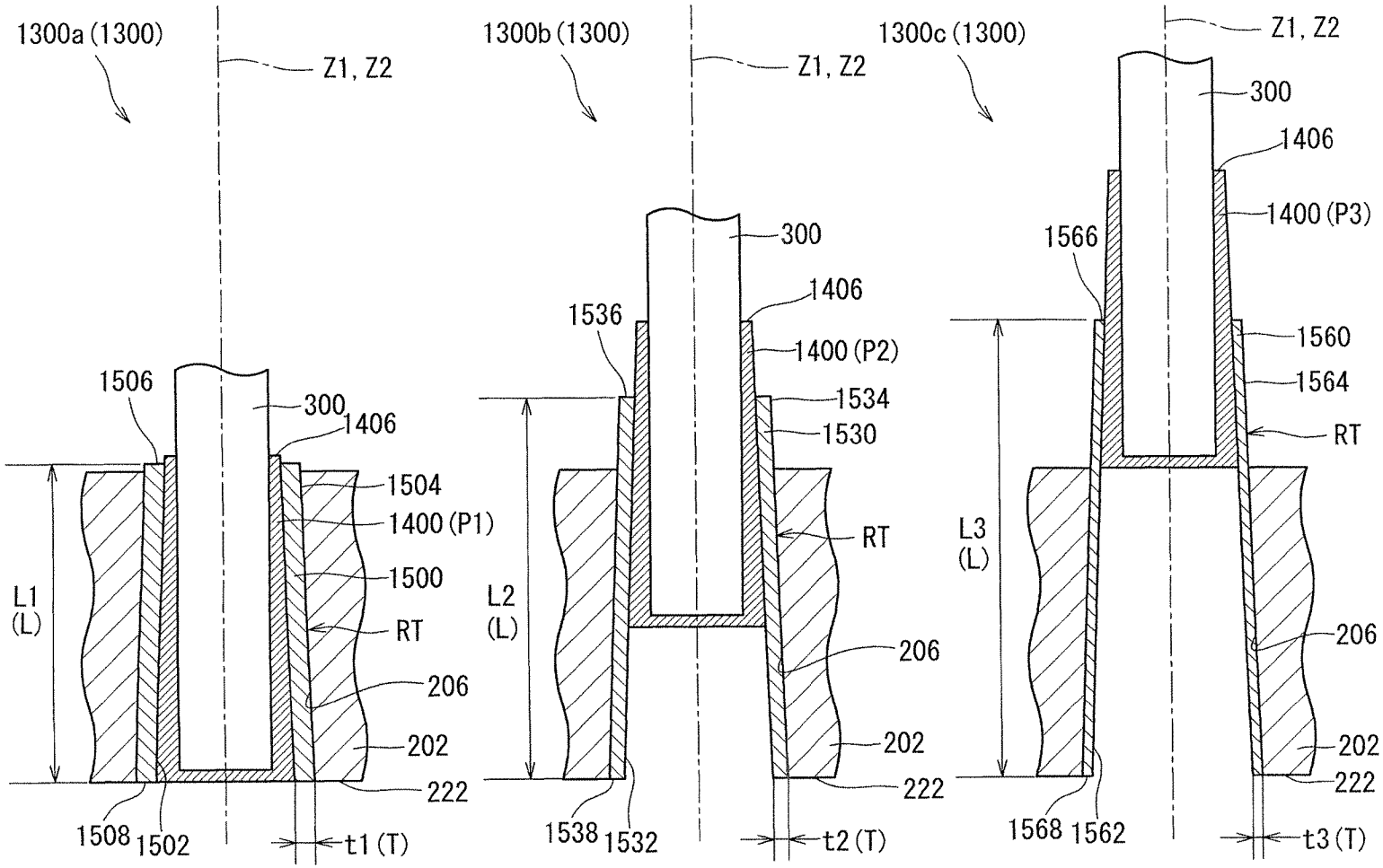
FIG. 22(*a*) to FIG. 22(*c*) are sectional views for illustrating a club length adjustment mechanism by replacing a sleeve.

FIG. 22(*a*) to FIG. 22(*c*) are sectional views of a golf club 1300 taken along the axial direction.

The golf club 1300 has a plurality of spacers 1500, 1530 and 1560 for adjusting club length. An assembled golf club includes any one of the spacers 1500, 1530 and 1560, and the others are spacers for replacement. The club length can be adjusted by replacing the spacer.

Hereinafter, a case where the spacer 1500 is used is referred to as a golf club 1300*a*. The golf club 1300*a* is in a state where the club length is the minimum. In the golf club 1300*a*, the tip engagement part RT is constituted by a sleeve 1400 and the spacer 1500. A case where the spacer 1530 is used is referred to as a golf club 1300*b*. The golf club 1300*b* is in a state where the club length is medium. In the golf club 1300*b*, the tip engagement part RT is constituted by the sleeve 1400 and the spacer 1530. A case where the spacer 1560 is used is referred to as a golf club 1300*c*. The golf club 1300*c* is in a state where the club length is the maximum. In the golf club 1300*c*, the tip engagement part RT is constituted by the sleeve 1400 and the spacer 1560.

Although not shown in the drawings, the spacers 1500, 1530 and 1560 each have a divided structure. The divided structure is the same as that of the above-described spacer 500 (FIG. 8). In addition, the sleeve 1400 can be made to pass through the reverse-tapered hole 206. The golf club 1300 (1300*a*, 1300*b* and 1300*c*) can be assembled by the procedure shown in FIG. 4.

FIG. 22(*a*) is a sectional view of the golf club 1300*a* taken along the axial direction. FIG. 22(*b*) is a sectional view of the golf club 1300*b* taken along the axial direction. FIG. 22(*c*) is a sectional view of the golf club 1300*c* taken along the axial direction.

As shown in FIG. 22(*a*) to FIG. 22(*c*), the spacers 1500, 1530 and 1560 are varied in wall thickness T. A wall thickness t2 of the second spacer 1530 is thinner than a wall thickness t1 of the first spacer 1500. A wall thickness t3 of the third spacer 1560 is thinner than the wall thickness t2 of the second spacer 1530.

As shown in FIG. 22(*a*) to FIG. 22(*c*), the spacers 1500, 1530 and 1560 are varied in length L. A length L2 of the second spacer 1530 is greater than a length L1 of the first spacer 1500. A length L3 of the third spacer 1560 is greater than the length L2 of the second spacer 1530. The thinner the spacer is, the longer the spacer is. That is, the smaller the wall thickness T of the spacer is, the greater the length L of the spacer is.

Because of the variations of the wall thicknesses T in the spacers, the spacers are varied in sectional area of an inner surface thereof. In a comparison of the spacers at a same axial direction position, the thinner the wall thickness T of the spacer is, the greater the sectional area of the inner surface of the spacer is. Specifically, in the comparison of the spacers at the same axial direction position, the sectional area of an inner surface 1532 of the second spacer 1530 is greater than the sectional area of an inner surface 1502 of the first spacer 1500. In the comparison of the spacers at the same axial direction position, the sectional area of an inner surface 1562 of the third spacer 1560 is greater than the sectional area of the inner surface 1532 of the second spacer 1530.

Therefore, in the engagement state, the axial direction positions of the sleeve 1400 with respect to the respective spacers are different from each other. The axial direction position of the sleeve 1400 which is engaged with the first spacer 1500 is represented by P1, the axial direction position of the sleeve 1400 which is engaged with the second spacer 1530 is represented by P2, and the axial direction position of the sleeve 1400 which is engaged with the third spacer 1560 is represented by P3. As shown in FIG. 22(*a*) to FIG. 22(*c*), the axial direction position P2 is located on an upper side relative to the axial direction position P1. The axial direction position P3 is located on an upper side relative to the axial direction position P2.

Because of the variations of the axial direction positions, club length is changed. The golf club 1300*b* is longer than the golf club 1300*a*. The golf club 1300*c* is longer than the golf club 1300*b*.

Thus, in the golf club 1300, the club length is changed by changing the wall thicknesses T of the respective spacers 1500, 1530 and 1560.

In the golf club 1300, lengths L of the respective spacers 1500, 1530 and 1560 varies with the variations of the wall thicknesses T thereof. That is, the smaller the wall thickness T is, the greater the length L is. For this reason, although the axial direction position of the sleeve 1400 is shifted, the engaging area of the sleeve 1400 with each of the spacers is maintained. The engaging area of each of the spacers with the reverse-tapered hole 206 is also maintained. Therefore, in all the golf club 1300*a*, the golf club 1300*b*, and the golf club 1300*c*, the fixation of the shaft 300 to the head 200 is attained to such an extent that the fixation endures actual hits.

A contact area of the sleeve and the spacer in the engagement state is represented by S. In the embodiment of FIG. 22(*a*) to FIG. 22(*c*), the contact area S of the golf club 1300*a* is represented by S1, the contact area S of the golf club 1300*b* is represented by S2, and the contact area S of the golf club 1300*c* is represented by S3. In the present embodiment, the formula S1>S2>S3 is satisfied. Thus, the contact area S is determined for each of the different club lengths. Of the contact areas S, the maximum value is represented by Smax, and the minimum value is represented by Smin. In the present embodiment, the maximum value Smax is S1, and the minimum value Smin is S3. In light of ensuring the holding of the shaft 300, Smin/Smax is preferably equal to or greater than 0.5, more preferably equal to or greater than 0.6, still more preferably equal to or greater than 0.7, still more preferably equal to or greater than 0.8, and yet still more preferably equal to or greater than 0.9. It is also preferable that Smin/Smax is 1.

In light of ensuring the holding of the shaft 300, the contact area S is preferably equal to or greater than 120 $mm^2$, more preferably equal to or greater than 360 $mm^2$, and still more preferably equal to or greater than 600 $mm^2$. An excessively large hosel part 202 decreases the degree of freedom in design of the head 200. In this respect, the contact area S is preferably equal to or less than 3000 $mm^2$, more preferably equal to or less than 2400 $mm^2$, and still more preferably equal to or less than 1800 $mm^2$.

As shown in FIG. 22(*a*) to FIG. 22(*c*), the first spacer 1500 has an upper end surface 1506 and a lower end surface 1508. The second spacer 1530 has an upper end surface 1536 and a lower end surface 1538. The third spacer 1560 has an upper end surface 1566 and a lower end surface 1568.

As shown in FIG. 22(*a*) to FIG. 22(*c*), in the golf clubs 1300*a*, 1300*b*, and 1300*c*, the axial direction positions of the lower end surfaces of the respective spacers are the same. It is not limited to such a structure. In the engagement state, the lower end surface of a spacer may be located at an upper side as the wall thickness T of the spacer becomes thinner. That is, in the engagement state, the lower end surface 1538 may be located on an upper side relative to the lower end surface 1508. In the engagement state, the lower end surface 1568 may be located on an upper side relative to the lower end surface 1538.

As shown in FIG. 22(*a*) to FIG. 22(*c*), in the golf clubs 1300*a*, 1300*b*, and 1300*c*, the upper end surfaces 1506, 1536, 1566 of the respective spacers are located on a lower side relative to an upper end surface 1406 of the sleeve 1400. In this embodiment, a stairs-shaped exposed part is formed by the spacer and the sleeve. The stairs-shaped exposed part is preferable because an appearance like a ferrule is attained. Of course, it is not limited to such a structure. The axial direction positions of the upper end surfaces 1506, 1536, 1566 of the respective spacers may be the same as the axial direction position of the upper end surface 1406 of the sleeve 1400. The upper end surfaces 1506, 1536, 1566 of the respective spacers maybe located on an upper side relative to the upper end surface 1406 of the sleeve 1400.

Figure 23:
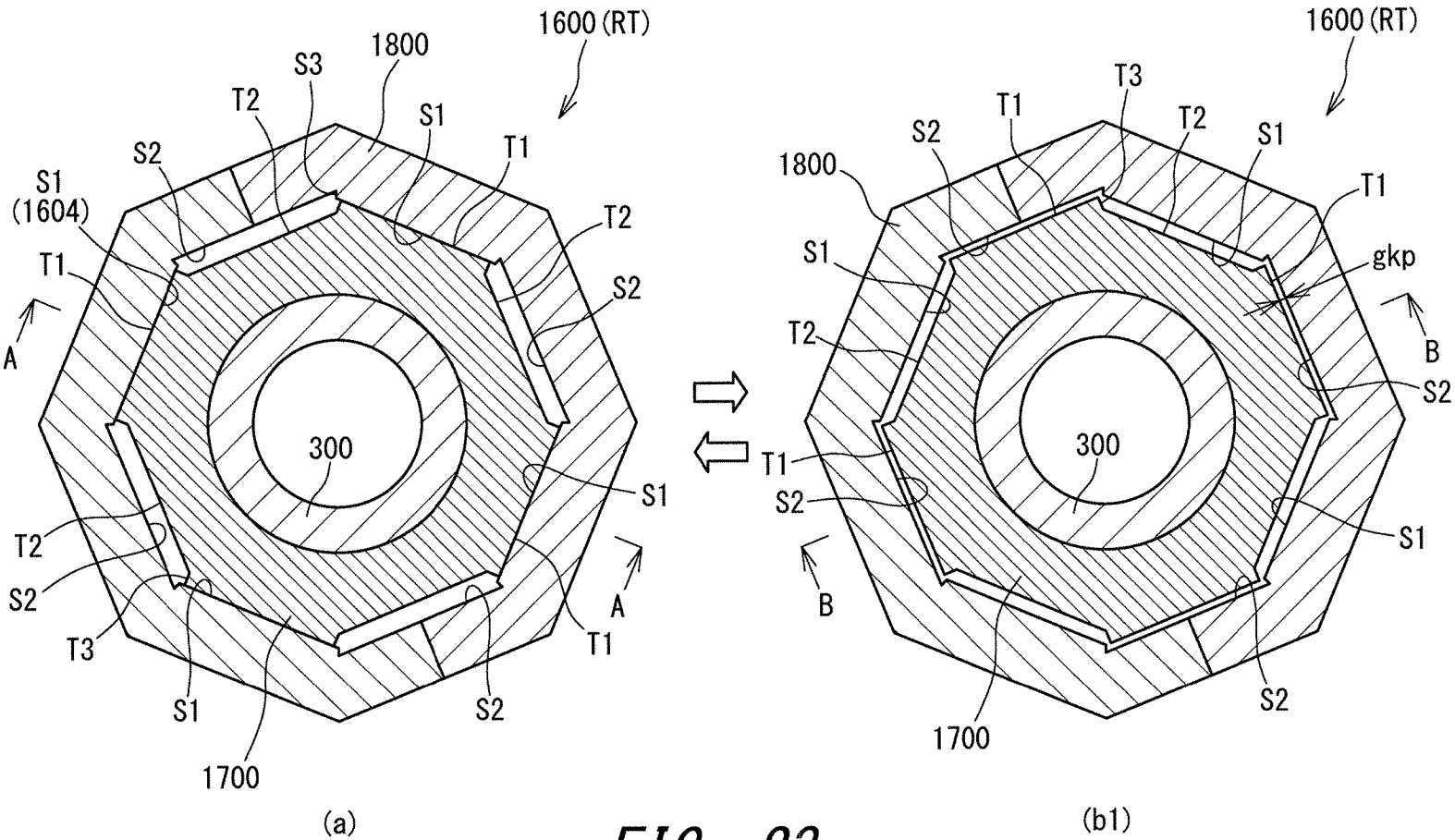
FIG. 23 is a sectional view (radial-direction sectional view) for illustrating a club length adjustment mechanism by changing a rotation position.

FIG. 23 is sectional views of a golf club 1600 according to another embodiment. In the golf club 1600, the club length can be changed without replacing a spacer.

FIG. 23 shows two states of the golf club 1600. A state (a) in FIG. 23 shows a first state of the golf club 1600. A state (b) in FIG. 23 shows a second state of the golf club 1600. The club length of the golf club 1600 in the first state is shorter than the club length of the golf club 1600 in the second state. In the golf club 1600, two kinds of length can be selected.

Figure 24:
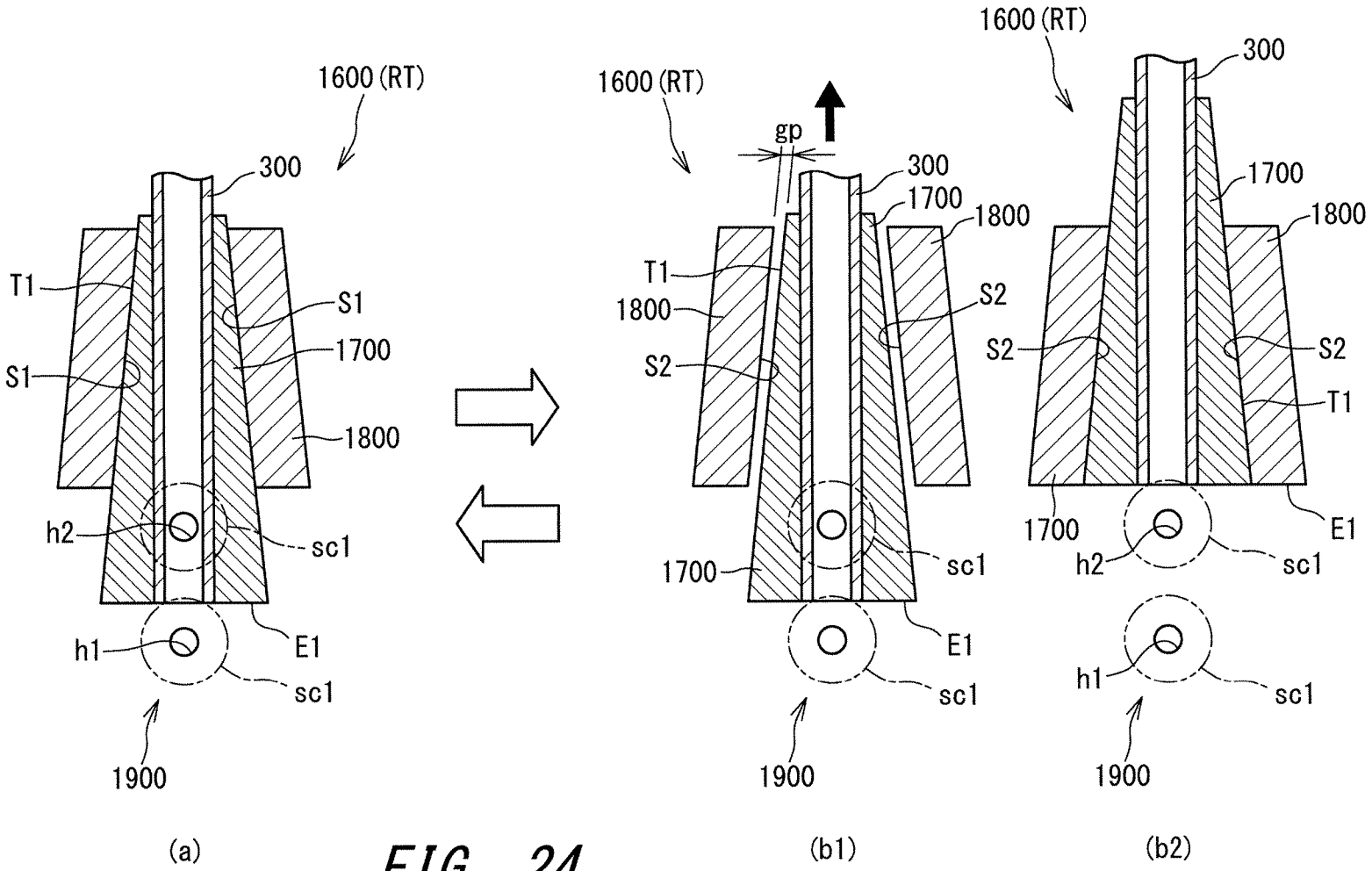
FIG. 24 is a sectional view (axial-direction sectional view) for illustrating the club length adjustment mechanism by changing the rotation position.

FIG. 24 is sectional views at a tip engagement part RT of the golf club 1600, which illustrates a length adjustment mechanism.

A state (a) in FIG. 24 is a sectional view in the first state (short state). As shown in the state (a) of FIG. 24, the tip engagement part RT of the golf club 1600 includes a sleeve 1700 and a spacer 1800.

The sleeve 1700 is bonded to the tip end portion of the shaft 300. The spacer 1800 has a divided structure. The sleeve 1700 can be made to pass through a hosel hole (not shown in the drawing). The golf club 1600 can be assembled by the procedure shown in FIG. 4.

As shown in FIG. 23, the inner surface of the spacer 1800 has a first abutting face S1 and the second abutting face S2.

A plurality of (four) first abutting faces S1 are provided on the inner surface of the spacer 1800. A plurality of (four) second abutting faces S2 are provided on the inner surface of the spacer 1800. The first abutting faces S1 and the second abutting faces S2 are alternately arranged. In the present embodiment, the number of the first abutting faces S1 is four, and the number of the second abutting faces S2 is four. The sum of the number of the first abutting faces S1 and the number of the second abutting faces S2 is eight.

As shown in the state (a) of FIG. 23, the first abutting faces S1 coincide with respective alternate sides of a regular polygon (regular octagon). The regular polygon (regular octagon) coinciding with the first abutting faces S1 is defined as a first virtual regular polygon (not shown in the drawing). As shown in the state (a) in FIG. 23, the second abutting faces S2 coincide with respective alternate sides of a regular polygon (regular octagon). The regular polygon (regular octagon) coinciding with the second abutting faces S2 is defined as a second virtual regular polygon (not shown in the drawing).

A radial direction position of the second abutting faces S2 is outside with respect to a radial direction position of the first abutting faces S1. The first virtual regular polygon (virtual regular octagon) is smaller than the second virtual regular polygon (virtual regular octagon). The first virtual regular polygon (virtual regular octagon) and the second virtual regular polygon (virtual regular octagon) have the common central point and the same phase.

Thus, the first abutting faces S1 and the second abutting faces S2 are alternately arranged along respective sides of a regular polygon (regular octagon), and the radial direction position of the first abutting faces S1 is (slightly) inside of the radial direction position of the second abutting faces S2. A step surface S3 is formed on each boundary between the first abutting faces S1 and the second abutting faces S2. The step surface S3 may not be present.

As shown in the state (a) in FIG. 23, the outer surface of the sleeve 1700 includes an abutting engagement face T1 and a non-abutting engagement face T2.

A plurality of (four) abutting engagement faces T1 are provided on the outer surface of the sleeve 1700. A plurality of (four) non-abutting engagement faces T2 are provided on the outer surface of the sleeve 1700. The abutting engagement faces T1 and the non-abutting engagement faces T2 are alternately arranged. In the present embodiment, the number of the abutting engagement faces T1 is four, and the number of the non-abutting engagement faces T2 is four. The sum of the number of the abutting engagement faces T1 and the number of the non-abutting engagement faces T2 is eight.

As shown in the state (a) in FIG. 23, the abutting engagement faces T1 coincide with respective alternate sides of a regular polygon (regular octagon). The regular polygon (regular octagon) coinciding with the abutting engagement faces T1 is defined as a third virtual regular polygon (not shown in the drawing). As shown in the state (a) in FIG. 23, the non-abutting engagement faces T2 coincide with respective alternate sides of a regular polygon (regular octagon). The regular polygon (regular octagon) coinciding with the non-abutting engagement faces T2 is defined as a fourth virtual regular polygon (not shown in the drawing).

A radial direction position of the abutting engagement faces T1 is outside with respect to a radial direction position of the non-abutting engagement faces T2. Therefore, the third virtual regular polygon (virtual regular octagon) is greater than the fourth virtual regular polygon (virtual regular octagon). The third virtual regular polygon (virtual regular octagon) and the fourth virtual regular polygon (virtual regular octagon) have the common central point and the same phase.

Thus, the abutting engagement faces T1 and the non-abutting engagement faces T2 are alternately arranged along respective sides of a regular polygon (regular octagon), and the radial direction position of the abutting engagement faces T1 is (slightly) outside of the radial direction position of the non-abutting engagement faces T2. A step surface T3 is formed on each boundary between the abutting engagement faces T1 and the non-abutting engagement faces T2. The step surface T3 may not be present.

The state (a) in FIG. 23 is a sectional view in the first state (a state where the club length is short). In the first state, the sleeve 1700 is set on a first rotation position.

In the first state, the abutting engagement faces T1 abut on the respective first abutting faces S1. In the first state, the abutting engagement faces T1 are opposed to the respective first abutting faces S1, and the non-abutting engagement faces T2 are opposed to the respective second abutting faces S2. While the abutting engagement faces T1 abut on the respective first abutting faces S1, the non-abutting engagement faces T2 do not abut on the respective second abutting faces S2. A gap is formed each between the non-abutting engagement faces T2 and the respective second abutting faces S2.

A state (b1) in FIG. 23 is a sectional view showing a shifting state for shifting to the second state. In the state (b1) of FIG. 23, the sleeve 1700 is set on a second rotation position.

The shifting state for shifting to the second state means a state in which the sleeve 1700 is rotated by a predetermined angle θ (45 degrees) without changing the axial direction position of the sleeve 1700 with respect to the spacer 1800. The shifting state is depicted in order to facilitate the understanding of the length adjustment mechanism. When the rotation of the predetermined angle θ is actually performed, the rotation can be made after once moving the tip engagement part RT in the engagement releasing direction. The rotation position of the sleeve 1700 is shifted to the second rotation position from the first rotation position by rotating the sleeve 1700 by the predetermined angle θ.

In the shifting state, the abutting engagement faces T1 are opposed to the respective second abutting faces S2, and the non-abutting engagement faces T2 are opposed to the respective first abutting faces S1. In this state, the abutting engagement faces T1 do not abut on the respective second abutting faces S2. As a matter of course, the non-abutting engagement faces T2 do not abut on the respective first abutting faces S1, either. A width of each gap gp between the abutting engagement face T1 and the second abutting face S2 is smaller than a width of each gap between the non-abutting engagement face T2 and the first abutting face S1.

The fact that the abutting engagement faces T1 do not abut on the respective second abutting faces S2 in the state (b1) (shifting state) of FIG. 23 shows the feasibility of two kinds of club lengths. That is, the gap gp realizes a second club length (greater club length). This point is explained below by using FIG. 24.

A state (a) in FIG. 24 is a sectional view taken along line A-A in the state (a) of FIG. 23. A state (b1) in FIG. 24 is a sectional view taken along line B-B in the state (b1) of FIG. 23. As also shown in the state (b1) in FIG. 24, in the shifting state, a gap gp is present at each of between the abutting engagement faces T1 and the respective second abutting faces S2. For eliminating the gap to abut the abutting engagement faces T1 on the respective second abutting faces S2, the shaft 300 to which the sleeve 1700 is fixed should be moved to axial-direction upper side. That is, the abutting engagement faces T1 abut on the respective second abutting faces S2 by moving the sleeve 1700 in the shifting state to the axial-direction upper side with respect to the spacer 1800. As a result, the second state is realized. A state (b2) in FIG. 24 shows the second state.

As described above, in the golf club 1600, the axial direction position of the sleeve 1700 with respect to the spacer 1800 in the first state is different from that of the second state. The first state in which the club length is short and the second state in which the club length is long are realized by the difference. In the golf club 1600, a mutual shifting between the first state and the second state is enabled by rotating the sleeve 1700 with respect to the spacer 1800.

The golf club 1600 includes a falling-off prevention mechanism 1900 by fastening with a screw. The falling-off prevention mechanism 1900 includes a plurality of screw holes h1 and h2, and a screw sc1 capable of being screwed to the screw holes h1 and h2. Plan views of the head part of the screw sc1 are shown by using two-dot chain lines in FIG. 24. The head part of the screw sc1 abuts on a lower end surface E1 of the sleeve 1700. As shown in the state (a) in FIG. 24, in the first state in which the club is short, the screw sc1 is screwed to the first screw hole h1 and abuts on the lower end surface El in the first state. As shown in the state (b2) in FIG. 24, in the second state in which the club is long, the screw sc1 is screwed to the second screw hole h2 and abuts on the lower end surface E1 in the second state. Thus, the falling-off prevention mechanism 1900 can support the lower end surface E1 of the sleeve 1700 at a plurality of axial direction positions.

Thus, in the present embodiment, the sleeve 1700 having a reverse-tapered outer surface and the spacer 1800 having a reverse-tapered inner surface are used. Either one of the reverse-tapered outer surface and the reverse-tapered inner surface includes the abutting engagement faces T1. The other of the reverse-tapered outer surface and the reverse-tapered inner surface includes the first abutting faces S1 and the second abutting faces S2. The first state in which the abutting engagement faces T1 abut on the respective first abutting faces S1 is formed when the reverse-tapered outer surface is set on the first rotation position. In addition, the second state in which the abutting engagement faces T1 abut on the respective second abutting faces S2 is formed when the reverse-tapered outer surface is set on the second rotation position. An axial direction position of the reverse-tapered outer surface with respect to the reverse-tapered inner surface in the first state is different from that of the second state, and a club length is adjusted by the difference. Preferably, the reverse-tapered outer surface includes the non-abutting engagement faces T2 in addition to the abutting engagement faces T1. Preferably, the reverse-tapered outer surface is a pyramid outer surface, and the abutting engagement faces and the non-abutting engagement faces are alternately arranged on the pyramid outer surface. Preferably, the radial direction position of the abutting engagement faces is located outside with respect to the radial direction position of the non-abutting engagement faces. Preferably, the reverse-tapered inner surface may be a pyramid inner surface corresponding to the pyramid outer surface, and the first abutting faces and the second abutting faces are alternately arranged on the pyramid inner surface. Preferably, the pyramid outer surface is an eight-sided pyramid surface. Preferably, the pyramid inner surface is an eight-sided pyramid surface.

Figure 25:
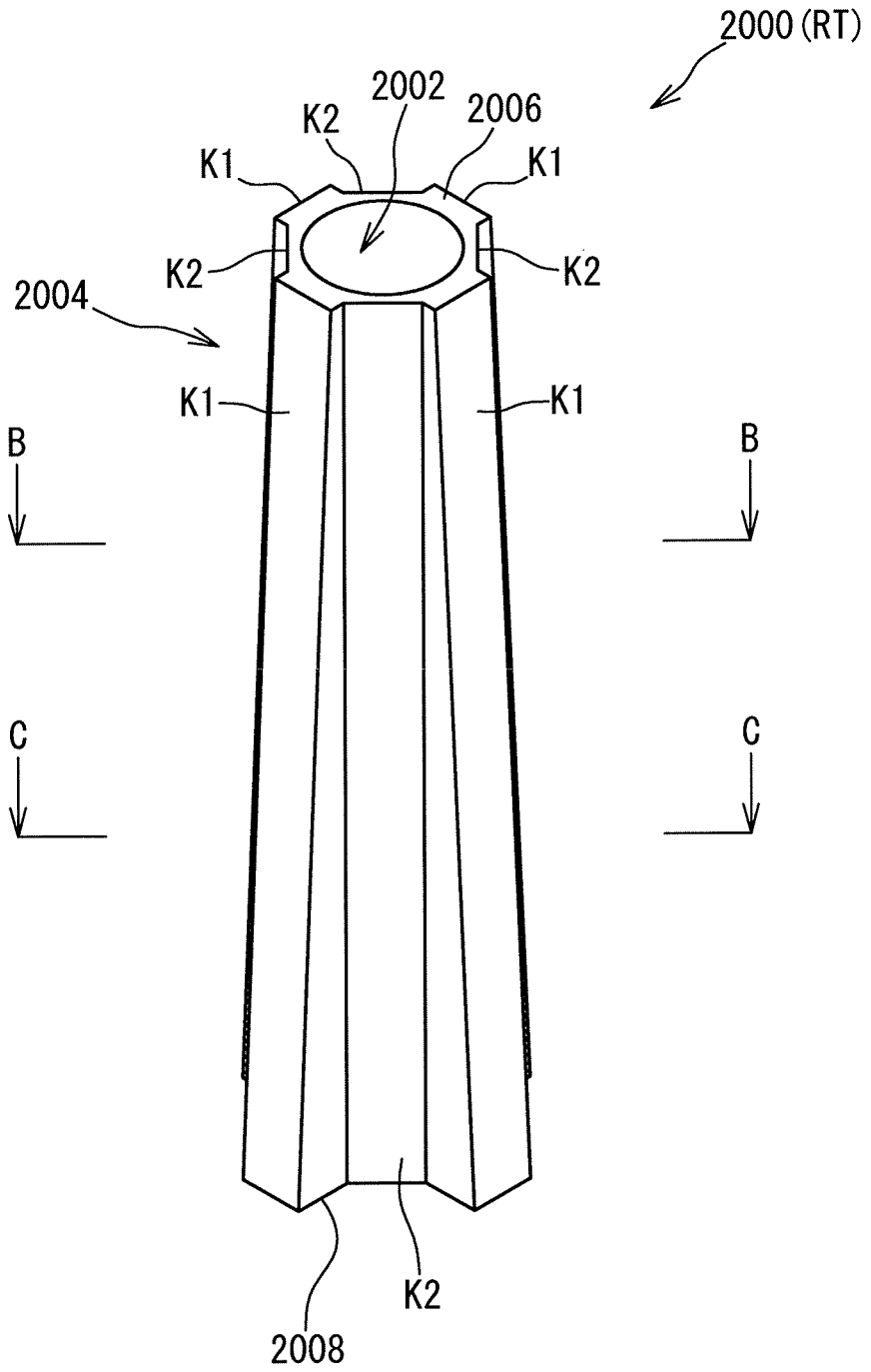
FIG. 25 is a perspective view of a sleeve according to another embodiment.
Figure 26A:
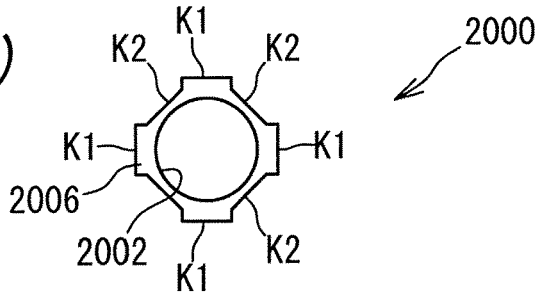
FIG. 26(*a*) is a top view of the sleeve shown in FIG. 25, FIG. 26(*b*) is a sectional view taken along line B-B in FIG. 25, FIG. 26(*c*) is a sectional view taken along line C-C in FIG. 25, and FIG. 26(*d*) is a sectional view taken along line D-D in FIG. 25.
Figure 26B:
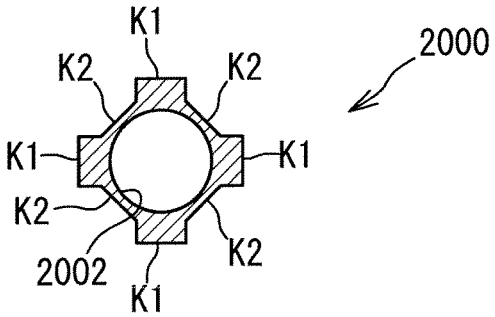
Figure 26C:
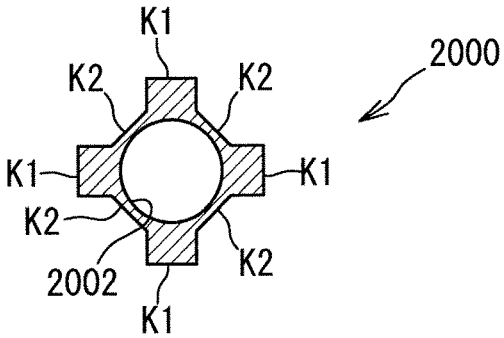
Figure 26D:
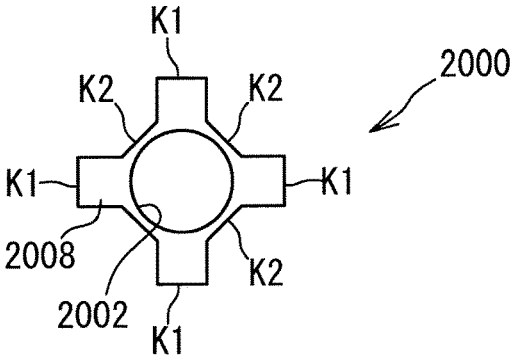
Figure 27A:
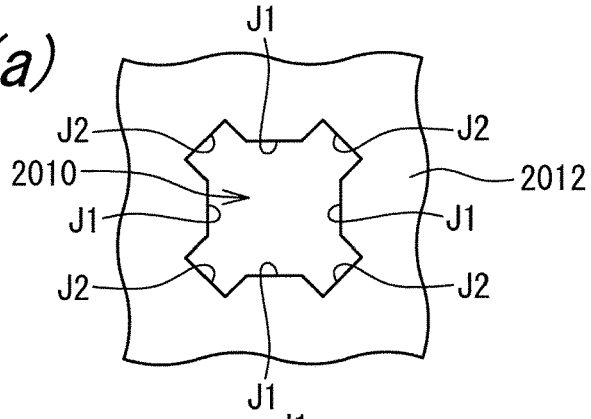
FIG. 27(*a*) to FIG. 27(*d*) show a hosel hole corresponding to the sleeve shown in FIG. 25, FIG. 27(*a*) is a plan view of an upper end of the hosel hole, FIG. 27(*b*) and FIG. 27(*c*) are sectional views of the hosel hole, and FIG. 27(*d*) is a plan view of a lower end of the hosel hole.
Figure 27B:
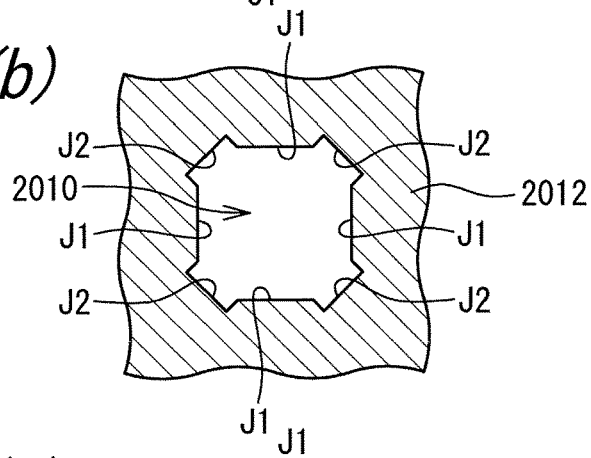
Figure 27C:
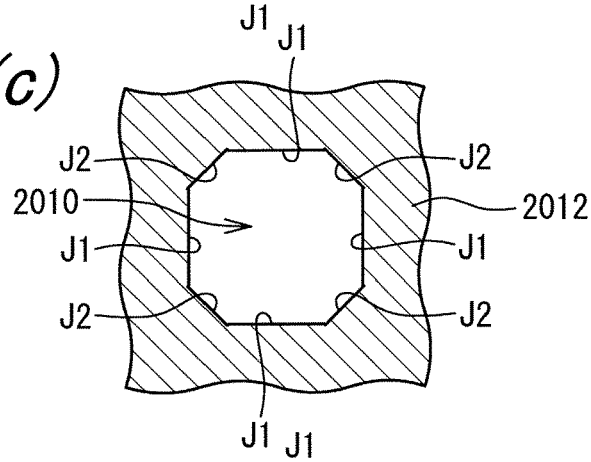
Figure 27D:
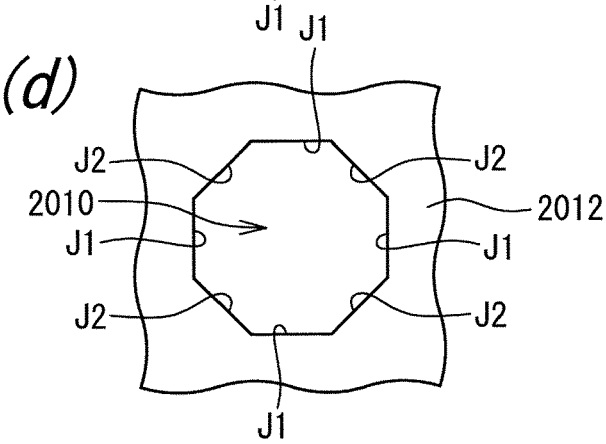

FIG. 25 is a perspective view of a sleeve 2000 according to another embodiment. FIG. 26(*a*) is a plan view of the sleeve 2000. FIG. 26(*b*) is a sectional view taken along line B-B in FIG. 25. FIG. 26(*c*) is a sectional view taken along line C-C in FIG. 25. FIG. 26(*d*) is a bottom view of the sleeve 2000.

The sleeve 2000 has an inner surface 2002, an outer surface 2004, an upper end surface 2006 and a lower end surface 2008.

The inner surface 2002 is a circumferential surface. A shaft is bonded to the inner surface 2002.

The outer surface 2004 has reverse-tapered engagement faces K1. The reverse-tapered engagement faces K1 are arranged at a plurality of positions in the circumferential direction. The reverse-tapered engagement faces K1 are arranged at equal intervals in the circumferential direction. The reverse-tapered engagement faces K1 are arranged at intervals of a predetermined angle (90 degree) in the circumferential direction.

The outer surface 2004 has non-engagement faces K2. The non-engagement faces K2 are arranged at a plurality of positions in the circumferential direction. The non-engagement faces K2 are arranged at equal intervals in the circumferential direction. The non-engagement faces K2 are arranged at intervals of a predetermined angle (90 degree) in the circumferential direction.

The reverse-tapered engagement faces K1 and the non-engagement faces K2 are alternately arranged in the circumferential direction.

As understood from FIG. 26(*a*) to FIG. 26(*d*), the sectional area of the outer surface 2004 is increased as going to the lower end surface 2008 from the upper end surface 2006. In the sectional shape of the outer surface 2004, the reverse-tapered engagement faces K1 are shifted toward radial direction outside as going to the lower side. As a result, the reverse-tapered engagement faces K1 becomes reverse-tapered surfaces (see FIG. 25).

The sectional shape of the non-engagement faces K2 is the same regardless of the axial direction position thereof. The sectional shape of the non-engagement faces K2 is along a polygon (regular polygon). The sectional shape of the non-engagement faces K2 is along an octagon (regular octagon). The sectional shape of the non-engagement faces K2 coincides with respective alternate sides of the regular polygon. The radial direction position of the non-engagement faces K2 remains the same at any axial direction position. At any axial direction position, the reverse-tapered engagement faces K1 are located outside of the non-engagement faces K2 in the radial direction.

The sectional shape of the outer surface 2004 has a rotation symmetric property at any axial direction position. At any axial direction position, the sectional shape of the outer surface 2004 has 4-fold rotation symmetry. When the sectional shape of the outer surface 2004 has n-fold rotation symmetry (n is an integer of equal to or greater than 2), n is preferably equal to or greater than 3 and equal to or less than 12, and more preferably equal to or greater than 4 and equal to or less than 8. In the present application, n means the maximum value in values n can take. For example, a square has 4-fold rotation symmetry, and also has 2-fold rotation symmetry. However, n of the square is the maximum value in the values n can take, that is, 4.

FIG. 27(*a*) to FIG. 27(*d*) shows a hosel hole 2010. FIG. 27(*a*) is a plan view of the hosel hole 2010, and shows the upper end of the hosel hole 2010. FIG. 27(*d*) is a bottom view of the hosel hole 2010, and shows the lower end of the hosel hole 2010. FIG. 27(*b*) and FIG. 27(*c*) are sectional views of the hosel hole 2010. FIG. 27(*b*) is a sectional view of the hosel hole 2010 at a position corresponding to line B-B in FIG. 25. FIG. 27(*c*) is a sectional view of the hosel hole 2010 at a position corresponding to line C-C in FIG. 25.

The hosel hole 2010 corresponds to the sleeve 2000. The sleeve 2000 is fixed to a tip end portion of a shaft (not shown in the drawings). The shaft to which the sleeve 2000 is fixed is fixed to the hosel hole 2010 of the head. The hosel hole 2010 is provided on a hosel part 2012 of the head.

The hosel hole 2010 has reverse-tapered hole faces J1. The reverse-tapered hole faces J1 are faces corresponding to the respective reverse-tapered engagement faces K1. The reverse-tapered hole faces J1 are arranged at a plurality of positions in the circumferential direction. The reverse-tapered hole faces J1 are arranged at equal intervals in the circumferential direction. The reverse-tapered hole faces J1 are arranged at intervals of a predetermined angle (90 degree) in the circumferential direction.

The hosel hole 2010 has interference-avoiding faces J2. The interference-avoiding faces J2 are arranged at a plurality of positions in the circumferential direction. The interference-avoiding faces J2 are arranged at equal intervals in the circumferential direction. The interference-avoiding faces J2 are arranged at intervals of a predetermined angle (90 degree) in the circumferential direction.

The reverse-tapered hole faces J1 and the interference-avoiding faces J2 are alternately arranged in the circumferential direction.

As understood from FIG. 27(*a*) to FIG. 27(*d*), the sectional area of the hosel hole 2010 is increased as going to the lower end from the upper end. In the sectional shape of the hose hole 2010, the reverse-tapered hole faces J1 are shifted toward radial direction outside as going to the lower side. The reverse-tapered hole faces J1 are reverse-tapered surfaces.

The radial direction position and orientation of the interference-avoiding faces J2 are the same regardless of the axial direction position thereof. The sectional shape of the interference-avoiding faces J2 is along a polygon (regular polygon). The sectional shape of the interference-avoiding faces J2 is along an octagon (regular octagon). The sectional shape of the interference-avoiding faces J2 coincide with respective alternate sides of the regular polygon. The radial direction position of the interference-avoiding faces J2 remains the same at any axial direction position. At any axial direction position other than lower ends of the interference-avoiding faces J2, the interference-avoiding faces J2 are positioned outside of the reverse-tapered hole faces J1 in the radial direction.

The sectional shape of the hosel hole 2010 has a rotation symmetric property at any axial direction position. At any axial direction position, the sectional shape of the hosel hole 2010 has 4-fold rotation symmetry. When the sectional shape of the hosel hole 2010 has n-fold rotation symmetry (n is an integer of equal to or greater than 2), n is preferably equal to or greater than 3 and equal to or less than 12, and more preferably equal to or greater than 4 and equal to or less than 8.

Figure 28A:
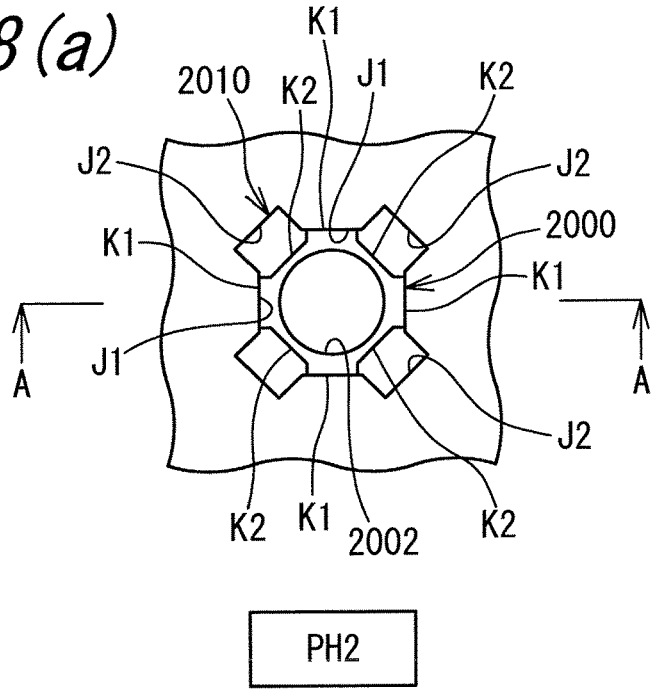
FIG. 28(*a*) is a plan view of a sleeve and a hosel hole in an engagement state (a second phase state), and FIG. 28(*b*) is a bottom view of the sleeve and the hosel hole in the engagement state (the second phase state)
Figure 28B:
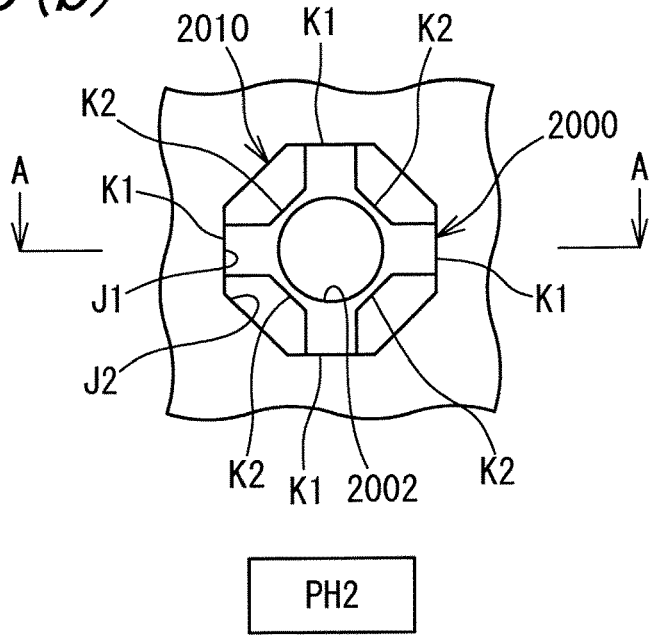
Figure 29:
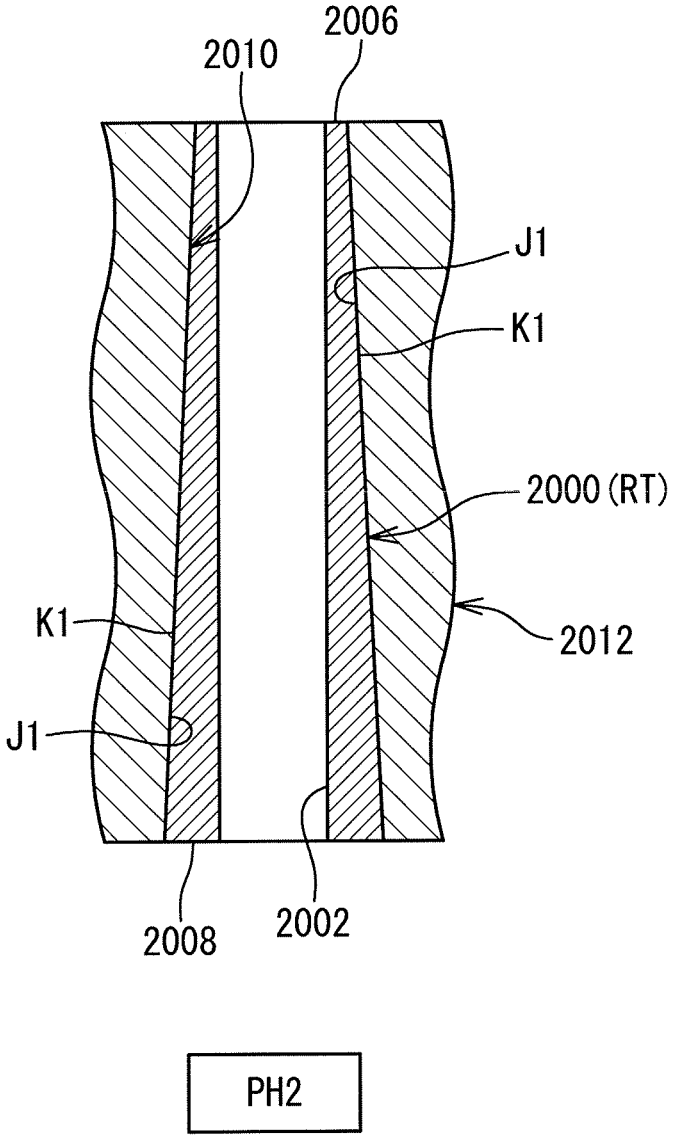
FIG. 29 is a sectional view taken along line A-A in FIG. 28(*a*)

FIG. 28(*a*) and FIG. 28(*b*) each show the sleeve 2000 and the hosel hole 2010 in the engagement state. FIG. 29 is a sectional view taken along line A-A in FIG. 28(*a*) and FIG. 28(*b*). The golf club according to the present embodiment becomes usable by the engagement state.

In the engagement state, the reverse-tapered engagement faces K1 abut on the respective reverse-tapered hole faces J1.

All the reverse-tapered engagement faces K1 abut on the respective reverse-tapered hole faces J1. The reverse-tapered engagement faces K1 are fitted to the reverse-tapered hole faces J1.

In the engagement state, the non-engagement faces K2 are opposed to the respective interference-avoiding faces J2. All the non-engagement faces K2 are opposed to the respective interference-avoiding faces J2. A gap (space) is present each between the non-engagement faces K2 and the respective interference-avoiding faces J2.

Figure 30:
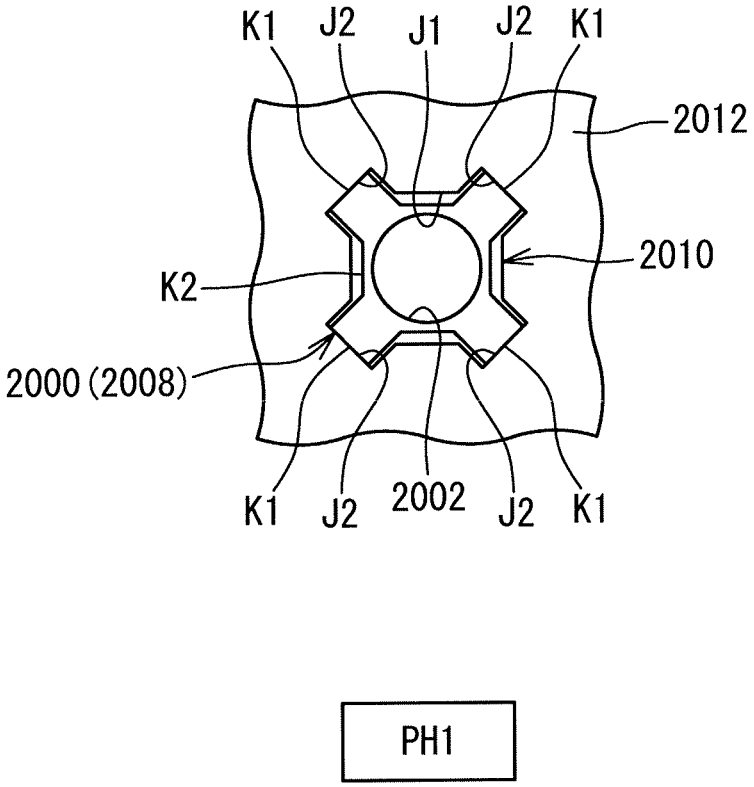
FIG. 30 is a plan view showing a relationship between a bottom surface of the sleeve the upper end of the hosel hole in a first-phase state.

FIG. 30 is a plan view showing the sleeve 2000 and the hosel hole 2010 in a process of passing the sleeve 2000 through the hosel hole 2010. FIG. 30 shows a state at a starting time of the passing process. FIG. 30 shows the upper end of the hosel hole 2010 (FIG. 27(*a*)) and the lower end surface 2008 of the sleeve 2000.

In the present embodiment, a spacer is not used. In the present embodiment, only the sleeve 2000 constitutes the tip engagement part RT.

As explained in FIG. 4, the tip engagement part RT can be made to pass through the hosel hole 2010. FIG. 30 shows the fact that the passing can be performed. The sleeve 2000 has the maximum sectional area at the lower end surface 2008 thereof. On the other hand, the hosel hole 2010 has the minimum sectional area at the upper end thereof. FIG. 30 shows that the lower end surface 2008 having the maximum sectional area can pass through the upper end of the hosel hole 2010 which has the minimum sectional area. The sleeve 2000 can pass through the hosel hole 2010. The sleeve 2000 can be inserted to the hosel hole 2010 from the upper side and can come out from the lower side of the hosel hole 2010.

In the present application, a first phase state PH1 and a second phase state PH2 are defined. The first phase state PH1 and the second phase state PH2 show relative phase relationships between the hosel hole 2010 and the sleeve 2000. A mutual shifting between the first phase state PH1 and the second phase state PH2 can be performed by rotating the sleeve 2000 with respect to the hosel hole 2010.

In the first phase state PH1, the reverse-tapered engagement faces K1 are opposed to the respective interference-avoiding faces J2. FIG. 30 shows the first phase state PH1. As described above, in the first phase state PH1 (FIG. 30), the hosel hole 2010 allows the tip engagement part RT (sleeve 2000) to pass through the hosel hole 2010. Although not clearly shown in FIG. 30, a (slight) clearance is present each between the reverse-tapered engagement faces K1 and the respective interference-avoiding faces J2.

In the first phase state PH1, the non-engagement faces K2 are opposed to the respective reverse-tapered hole faces J1. In the first phase state PH1, a gap is present each between the non-engagement faces K2 and the reverse-tapered hole faces J1.

In the second phase state PH2, the reverse-tapered engagement faces K1 are opposed to the respective reverse-tapered hole faces J1. FIG. 28(*a*) and FIG. 28(*b*) show the second phase state PH2. In the second phase state PH2, the engagement state is achieved. As described above, in the engagement state, the reverse-tapered engagement faces K1 are brought into surface-contact with the respective reverse-tapered hole faces J1. In the second phase state PH2, the reverse-tapered engagement faces K1 can be fitted to the respective reverse-tapered hole faces J1.

Thus, for assembling the golf club according to the present embodiment, the sleeve 2000 is fixed (bonded) to the tip end portion of a shaft. Next, the sleeve 2000 is inserted to the hosel hole 2010 from above, and is made to completely pass through the hosel hole 2010. By the passing, the sleeve 2000 reaches the lower side of the sole, and the shaft is inserted to the hosel hole 2010. In the passing process, the first phase state PH1 is adopted (see FIG. 30). Next, the sleeve 2000 fixed to the shaft is rotated so that the first phase state PH1 is shifted to the second phase state PH2. The sleeve 2000 is exposed to the outside, and thus can be freely rotated. In the present embodiment, the angle of the rotation is 45 degrees. Finally, the shaft to which the sleeve 2000 is fixed is pulled up, and the reverse-tapered engagement faces K1 are fitted to the respective reverse-tapered hole faces J1. This final state is shown in FIG. 28(*a*), FIG. 28(*b*) and FIG. 29.

Thus, the first phase state PH1 enables the sleeve 2000 to pass through the hosel hole 2010. The second phase state PH2 enables the sleeve 2000 to be fitted to the hosel hole 2010.

In the sleeve 2000, a center line of the sleeve inner surface 2002 is not inclined with respect to a center line of the sleeve outer surface. Of course, the center line of the sleeve inner surface 2002 may be inclined with respect to the center line of the sleeve outer surface. The center line of the sleeve inner surface 2002 maybe parallel and eccentric with respect to the center line of the sleeve outer surface.

In the present embodiment, a spacer is not used. However, a spacer can be provided. For example, the shape of the sleeve 2000 can be formed by a spacer and a sleeve. In this case, the outer shape of the sleeve may be a regular eight-sided pyramid having a reverse-tapered shape. The spacer suited to the sleeve may have an inner shape of a regular eight-sided pyramid corresponding to the outer shape of the sleeve, and may have an outer shape which is the same as the shape of the sleeve 2000. When a spacer is used, an inclination angle can be set between the center line of the inner shape of the sleeve and the center line of the outer shape of the sleeve, and an inclination angle can be set between the center line of the inner shape of the spacer and the center line of the outer shape of the spacer. In this case, as described above, an independent variability of the loft angle and an independent variability of the lie angle can be attained.

A taper ratio of the reverse-tapered fitting is not limited. When the taper ratio is excessively small, it may be difficult to release the reverse-tapered fitting. Meanwhile, when the taper ratio is excessively large, the size of the fitting portion becomes large. An excessively large fitting portion deteriorates the degree of freedom of design of the golf club. In this respect, the taper ratio is preferably set within a predetermined range.

In the above-explained respects, the outer surface of the sleeve has a taper ratio of preferably equal to or greater than 0.2/30, more preferably equal to or greater than 0.5/30, and still more preferably equal to or greater than 1.0/30. In the above-explained respects, the taper ratio of the outer surface of the sleeve is preferably equal to or less than 5/30, more preferably equal to or less than 4/30, and still more preferably equal to or less than 3.5/30.

In the above-explained respects, the inner surface of the spacer has a taper ratio of preferably equal to or greater than 0.2/30, more preferably equal to or greater than 0.5/30, and still more preferably equal to or greater than 1.0/30. In the above-explained respects, the taper ratio of the inner surface of the spacer is preferably equal to or less than 5/30, more preferably equal to or less than 4/30, and still more preferably equal to or less than 3.5/30.

In the above-explained respects, the outer surface of the spacer has a taper ratio of preferably equal to or greater than 0.2/30, ore preferably equal to or greater than 0.5/30, and still more preferably equal to or greater than 1.0/30. In the above-explained respects, the taper ratio of the outer surface of the spacer is preferably equal to or less than 10/30, more preferably equal to or less than 7/30, and still more preferably equal to or less than 5/30.

In the above-explained respects, the reverse-tapered hole has a taper ratio of preferably equal to or greater than 0.2/30, more preferably equal to or greater than 0.5/30, and still more preferably equal to or greater than 1.0/30. In the above-explained respects, the taper ratio of the reverse-tapered hole is preferably equal to or less than 10/30, more preferably equal to or less than 7/30, and still more preferably equal to or less than 5/30.

In the above-explained respects, the reverse-tapered engagement faces have a taper ratio of preferably equal to or greater than 0.2/30, more preferably equal to or greater than 0.5/30, and still more preferably equal to or greater than 1.0/30. In the above-explained respects, the taper ratio of the reverse-tapered engagement faces is preferably equal to or less than 10/30, more preferably equal to or less than 7/30, and still more preferably equal to or less than 5/30.

In the above-explained respects, the reverse-tapered hole faces have a taper ratio of preferably equal to or greater than 0.2/30, more preferably equal to or greater than 0.5/30, and still more preferably equal to or greater than 1.0/30. In the above-explained respects, the taper ratio of the reverse-tapered hole faces is preferably equal to or less than 10/30, more preferably equal to or less than 7/30, and still more preferably equal to or less than 5/30.

The definition of the taper ratio is as follows. When a length in an axial direction of the tapered surface is represented by Da, and a varied width in a direction perpendicular to the axial direction is represented by Db, then the taper ratio is Db/Da. In the taper ratio, varied amount in both sides, not an inclination (gradient) in one side, is considered. For example, in a case of a circular cone, the varied width Db is a varied amount of a diameter thereof, not a radius thereof. For example, in a case of a regular quadrangular pyramid, although the sectional shape of the regular quadrangular pyramid is a square, the varied width Db is a varied amount of the length of one side of the square.

The sectional area of the reverse-tapered hole is gradually increased toward the lower side (sole side). The sectional shape of the reverse-tapered hole is a non-circle. The sectional shape of the non-circle prevents relative rotation between the hosel hole and the tip engagement part. The non-circle includes all shapes other than a circle. For example, the non-circle may be a shape having a projection, a recess, or a flat portion at at least a part in the circumferential direction of a circle. The sectional shape of the reverse-tapered hole may be a polygon. Examples of the polygon include a triangle, a tetragon, a pentagon, a hexagon, a heptagon, an octagon, and a dodecagon. The polygon may be an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the reverse-tapered hole may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are more preferable.

The reverse-tapered hole preferably includes a plurality of faces. Each of the faces may be a plane face, or may be a curved face. From the viewpoint of ensuring surface-contact with the tip engagement part, each of these faces is preferably a plane face. From the viewpoint of ensuring surface-contact with the tip engagement part, the reverse-tapered hole may be a pyramid surface. The pyramid surface means apart of the outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

When the reverse-tapered hole faces J1 are adopted as in the embodiment of FIG. 25 to FIG. 30, each of the reverse-tapered hole faces J1 may be a plane face, or may be a curved face. From the viewpoint of ensuring surface-contact with the reverse-tapered engagement faces K1, each of the reverse-tapered hole faces J1 is preferably a plane face. From the viewpoint of ensuring surface-contact with the reverse-tapered engagement faces K1, the reverse-tapered hole faces J1 may constitute a pyramid surface. The pyramid surface means a part of the outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

The area of a figure formed by a sectional line of the outer surface of the sleeve is gradually increased toward the lower side (sole side). The sectional shape of the outer surface of the sleeve is a non-circle. The sectional shape of the non-circle prevents relative rotation between the sleeve and an abutting portion. The abutting portion is the inner surface of the spacer or the reverse-tapered hole. When a plurality of spacers are present, the abutting portion is the inner surface of the innermost spacer. The non-circle includes all shapes other than a circle. For example, the non-circle may be a shape having a projection, a recess, or a flat portion at at least a part in the circumferential direction of a circle. The sectional shape of the outer surface of the sleeve may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the outer surface of the sleeve may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are more preferable.

The outer surface of the sleeve preferably includes a plurality of faces. Each of the faces may be a plane face, or may be a curved face. From the viewpoint of ensuring surface-contact with the abutting portion, each of these faces is preferably a plane face. From the viewpoint of ensuring surface-contact with the abutting portion, the outer surface of the sleeve is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface, and the eight-sided pyramid surface are more preferable.

As described above, the golf club may have one or more spacers. The inner surface of the spacer has the same shape as the shape of an outer surface of a member (inner member) fitted inside the spacer. The inner member is the sleeve or another spacer.

The area of a figure formed by a sectional line of the inner surface of the spacer is gradually increased toward the lower side (sole side). The sectional shape of the inner surface of the spacer is a non-circle. The sectional shape of the non-circle prevents relative rotation between the spacer and the inner member. When a plurality of spacers are present, the inner member is another spacer. The non-circle includes all shapes other than a circle. For example, the non-circle may be a shape having a projection, a recess, or a flat portion at at least a part in the circumferential direction of a circle. The sectional shape of the inner surface of the spacer may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the inner surface of the spacer may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are more preferable.

The inner surface of the spacer preferably includes a plurality of faces. Each of the faces may be a plane face, or may be a curved face. From the viewpoint of ensuring surface-contact with the inner member, each of these faces is preferably a plane face. From the viewpoint of ensuring surface-contact with the inner member, the inner surface of the spacer may be a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

As described above, the club of the present disclosure includes a tip engagement part. The tip engagement part may be constituted with only the sleeve, or may by constituted with the sleeve and one or more spacers. When the spacer is not used, the outer surface of the tip engagement part is the outer surface of the sleeve. When one spacer is used, the outer surface of the tip engagement part is the outer surface of the spacer. When two or more spacers are used, the outer surface of the tip engagement part is the outer surface of the outermost spacer.

The area of a figure formed by a sectional line of the outer surface of the tip engagement part is gradually increased toward the lower side (sole side). The sectional shape of the outer surface of the tip engagement part is a non-circle. The sectional shape of the non-circle prevents relative rotation between the tip engagement part and the reverse-tapered hole. The non-circle includes all shapes other than a circle. For example, the non-circle may be a shape having a projection, a recess, or a flat portion at at least a part in the circumferential direction of a circle. The sectional shape of the outer surface of the tip engagement part may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the outer surface of the tip engagement part may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are more preferable.

The outer surface of the tip engagement part preferably includes a plurality of faces. Each of the faces may be a plane face, or may be a curved face. From the viewpoint of ensuring surface-contact with the reverse-tapered hole, each of these faces is preferably a plane face. From the viewpoint of ensuring surface-contact with the reverse-tapered hole, the outer surface of the tip engagement part may be a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

When the tip engagement part RT is the sleeve 2000 (FIG. 25), the number of the reverse-tapered engagement faces K1 is preferably plural, and each of the reverse-tapered engagement faces K1 may be a plane face, or may be a curved face. From the viewpoint of ensuring surface-contact with the reverse-tapered hole faces J1, each of these faces is preferably a plane face. From the viewpoint of ensuring surface-contact with the reverse-tapered hole faces J1, the reverse-tapered engagement faces K1 preferably constitutes a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

Each of the above-mentioned numbers N is preferably an integer of equal to or greater than 3.

Thus, the reverse-tapered fitting is formed by the sleeve and the reverse-tapered hole while one or more spacers are interposed as necessary. The reverse-tapered fitting is easily released by applying a force in the engagement releasing direction. In addition, the reverse-tapered fitting is easily formed by applying a force in the engaging direction. The shaft is easily attached to, and detached from the head.

The above-described embodiments differ from the golf club described in JP2006-42950 in many aspects.

Unlike the golf club of JP2006-42950, in each of the embodiments, the outer surface of the sleeve has the reverse-tapered surface. Therefore, the shaft is easily attached and detached.

Unlike the description of JP2006-42950, in the golf club 100 of the above-described embodiment, the hosel hole allows the sleeve to pass through the hosel hole. Therefore, the shaft can be attached by the procedure shown in FIG. 4. Thus, the shaft is easily attached and detached.

Unlike the description of JP2006-42950, a connecting part is provided in the spacer 500 (FIG. 8), etc. in the embodiments. Therefore, in a situation where the spacer is rotated for adjusting an angle, the spacer is prevented from falling off.

Unlike the description of JP2006-42950, in the sleeve 400*b* (FIG. 11), etc. of the embodiments, the centerline of the inner surface of the sleeve is inclined with respect to the center line of the outer surface of the sleeve. Therefore, angle adjustment having a high degree of freedom can be attained by simply rotating the sleeve.

Unlike the description of JP2006-42950, in the sleeve and the spacer of the embodiments, each sectional shape thereof is a polygon. Therefore, a reverse-tapered shape having a high attachability/detachability is easily formed, and anti-rotation is also attained. In addition, angle adjustment having a high degree of freedom is enabled.

Unlike the description of JP2006-42950, in the embodiment of FIG. 6, each of the sectional shapes of the sleeve and the spacer is a regular tetragon. In the embodiment of FIG. 7, each of the sectional shape of the sleeve and the spacer is a regular octagon. As described above, these shapes are suited for independent variability.

Unlike the description of JP2006-42950, in the embodiments, taper ratios of the tapered surfaces are set to respective preferable numerical ranges. Therefore, attachment and detachment are easily performed, and an excessively large tip engagement part can be prevented.

Unlike the description of JP2006-42950, in the embodiments, the falling-off prevention mechanism is provided on the sole side of the tip engagement part. The falling-off prevention mechanism provided on the sole side is compatible with the club length adjustment mechanism.

The material of the sleeve is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic.

The material of the spacer is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic. From the viewpoint of moldability, the resin is preferable.

As described above, the embodiments include an adjusting mechanism capable of adjusting the position and/or angle of the center line of the shaft. The embodiments also include a falling-off prevention mechanism. These mechanisms preferably satisfy the Golf Rules defined by R&A (The Royal and Ancient Golf Club of Saint Andrews). That is, the mechanisms preferably satisfy requirements specified in "1*b* Adjustability" in "1. Clubs" of "Appendix II Design of Clubs" defined by R&A. The requirements specified in the "1*b* Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform to the Rules.

The disclosure described above can be applied to all golf clubs such as a wood type golf club, a hybrid type golf club, an iron type golf club, and a putter.

The above description is merely illustrative example, and various modifications can be made without departing from the principles of the present disclosure.

What is claimed is:

1. A golf club comprising:

a head having a hosel part;

a shaft; and a tip engagement part having a reverse-tapered shape and being disposed at a tip end portion of the shaft, wherein the tip engagement part includes: a sleeve having a reverse-tapered shape and being fixed to the tip end portion of the shaft; and at least one spacer having a reverse-tapered shape and being externally fitted to the sleeve, the at least one spacer has a divided structure, the hosel part has a hosel hole, the hosel hole has a reverse-tapered hole having a shape corresponding to a shape of an outer surface of the tip engagement part, the hosel hole allows the sleeve to pass though the hosel hole, the tip engagement part is fitted to the reverse-tapered hole, and the sleeve is fitted inside the at least one spacer, the head further includes a falling-off prevention mechanism regulating moving of the tip engagement part in an engagement releasing direction, and the falling-off prevention mechanism is provided on a sole side of the hosel hole.

2. The golf club according to claim 1, wherein the at least one spacer includes a first divided body, a second divided body and a connecting part capable of maintaining a connected state in which the first divided body and the second divided body are connected to each other.

3. The golf club according to claim 1, wherein a center line of an inner surface of the sleeve is inclined with respect to a center line of an outer surface of the sleeve.

4. The golf club according to claim 1, wherein an outer surface of the sleeve is a pyramid surface, and an outer surface of the at least one spacer is a pyramid surface.

5. The golf club according to claim 1, wherein the at least one spacer comprises two spacers or three spacers, and the two or three spacers are layered on each other.

6. The golf club according to claim 1, wherein the tip engagement part has a taper ratio of equal to or greater than 0.2/30 and equal to or less than 10/30, and the reverse-tapered hole has a taper ratio of equal to or greater than 0.2/30 and equal to or less than 10/30.

7. The golf club according to claim 1, wherein the reverse-tapered hole has a sectional area being increased toward a lower side, an area of a figure formed by a sectional line of an outer surface of the sleeve is increased toward the lower side, an area of a figure formed by a sectional line of an inner surface of the at least one spacer is increased toward the lower side, and an area of a figure formed by a sectional line of the outer surface of the tip engagement part is increased toward the lower side.

8. A golf club comprising:

a head having a hosel part;

a shaft; and a tip engagement part having a reverse-tapered shape and being disposed at a tip end portion of the shaft, wherein the tip engagement part includes: a sleeve having a reverse-tapered shape and being fixed to the tip end portion of the shaft; and at least one spacer having a reverse-tapered shape and being externally fitted to the sleeve, the at least one spacer has a divided structure, the hosel part has a hosel hole, the hosel hole has a reverse-tapered hole having a shape corresponding to a shape of an outer surface of the tip engagement part, the hosel hole allows the sleeve to pass though the hosel hole, the tip engagement part is fitted to the reverse-tapered hole, and the sleeve is fitted inside the at least one spacer, and a center line of an inner surface of the sleeve is inclined with respect to a center line of an outer surface of the sleeve.

* * * * *